US011353819B2

(12) United States Patent
Nakajima

(10) Patent No.: US 11,353,819 B2
(45) Date of Patent: Jun. 7, 2022

(54) HEATING APPARATUS CONFIGURED TO DETECT CONDUCTIVE STATE OF ELEMENT, AND IMAGE FORMING APPARATUS

(71) Applicant: Canon Kabushiki Kaisha, Tokyo (JP)

(72) Inventor: Nozomu Nakajima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/193,257

(22) Filed: Mar. 5, 2021

(65) Prior Publication Data

US 2021/0278794 A1 Sep. 9, 2021

(30) Foreign Application Priority Data

Mar. 6, 2020 (JP) ..... JP2020-038910

(51) Int. Cl.
*G03G 15/00* (2006.01)
*G03G 15/20* (2006.01)

(52) U.S. Cl.
CPC ..... *G03G 15/80* (2013.01); *G03G 15/205* (2013.01); *G03G 15/2039* (2013.01); *G03G 15/5004* (2013.01)

(58) Field of Classification Search
CPC .. G03G 15/80; G03G 15/205; G03G 15/5004; G03G 15/2039
USPC ..... 399/37, 69, 88, 90
See application file for complete search history.

(56) References Cited

U.S. PATENT DOCUMENTS 6,947,683 B2 9/2005 Na
9,229,384 B2 1/2016 Shimura et al.
9,575,456 B2 2/2017 Itoh
2012/0321334 A1* 12/2012 Asano ..... G03G 15/205 399/69
2015/0220043 A1* 8/2015 Kinoshita ..... G03G 15/2042 399/69
2017/0068203 A1* 3/2017 Kinoshita ..... G03G 15/80
(Continued)

FOREIGN PATENT DOCUMENTS

JP 2001100558 A 4/2001
JP 2004038174 A 2/2004
(Continued)

OTHER PUBLICATIONS

Co-pending U.S. Appl. No. 17/193,220, filed Mar. 5, 2021.
Co-pending U.S. Appl. No. 17/227,588, filed Apr. 12, 2021.

*Primary Examiner* — Robert B Beatty
(74) *Attorney, Agent, or Firm* — Venable LLP

(57) ABSTRACT

A heating apparatus including: a first load; a first switch element configured to switch supply and shut-off of power from an AC power source to the first load; a second load; a second switch element configured to switch supply and shut-off of power from the AC power source to the second load; a control unit configured to control the first and the second switch elements to supply power to either the first load or the second load; a first detection unit configured to detect whether the first switch element is in a conductive state; a second detection unit configured to detect whether the second switch element is in a conductive state; and a determination unit configured to determine whether both of the first load and the second load are in a state of being supplied with power, based on detection results of the first and the second detection units.

19 Claims, 9 Drawing Sheets

(56) References Cited

U.S. PATENT DOCUMENTS

| | | | | |
|---|---|---|---|---|
| 2018/0314196 | A1* | 11/2018 | Kojima | G03G 15/2064 |
| 2018/0335737 | A1* | 11/2018 | Ogura | G03G 15/2053 |
| 2019/0302663 | A1* | 10/2019 | Harada | H05B 1/0241 |
| 2020/0233348 | A1 | 7/2020 | Nakajima et al. | |
| 2020/0233350 | A1* | 7/2020 | Oi | G03G 15/80 |
| 2021/0072681 | A1* | 3/2021 | Wakatsu | G03G 15/2053 |

FOREIGN PATENT DOCUMENTS

| | | | |
|---|---|---|---|
| JP | 2006004860 | A | 1/2006 |
| JP | 5577077 | B | 8/2014 |
| JP | 2015072333 | A | 4/2015 |
| JP | 2015187708 | A | 10/2015 |

* cited by examiner

HEATING APPARATUS CONFIGURED TO DETECT CONDUCTIVE STATE OF ELEMENT, AND IMAGE FORMING APPARATUS

BACKGROUND OF THE INVENTION

Field of the Invention

The present invention relates to a heating apparatus configured to detect a conductive state of an element, and to an image forming apparatus.

Description of the Related Art

With regard to temperature rise of a non-sheet passing portion caused in an image heating apparatus of an image forming apparatus, the following unit is proposed: a heater includes a plurality of heating elements, and power supply to the plurality of heating elements is controlled in accordance with a width of a recording sheet, to thereby suppress the temperature rise of the non-sheet passing portion. Here, image heating apparatus including a plurality of heating elements are broadly classified into two systems. A first system corresponds to a method of causing the plurality of heating elements to generate heat at the same time when in use (for example, see Japanese Patent Application Laid-Open No. 2006-004860). The second system corresponds to a method of exclusively supplying power to any of the heating elements (for example, see Japanese Patent Application Laid-Open No. 2001-100558). Specifically, for example, during power supply to a heating element 1, no power is supplied to a heating element 2, or during power supply to the heating element 2, no power is supplied to the heating element 1. As compared with the first system, the second system is advantageous in that the heater can be manufactured in a simple manner at low cost, and is suitable for low-cost image forming apparatus.

With the image heating apparatus of the second system, when power is supplied to the plurality of heating elements at the same time, the apparatus may be finally broken. To address the above, it is required to prevent such a situation that a plurality of triacs configured to control power supply to the plurality of heating elements have any failure and then supply power to the plurality of heating elements at the same time. To that end, there is proposed a technology of accurately detecting a failure (abnormality) of the triac (for example, see Japanese Patent Application Laid-Open No. 2001-100558 and Japanese Patent No. 5577077).

However, in order to prevent power from being supplied to the plurality of heating elements at the same time, it is required to detect a power supply state of each of the plurality of triacs and then determine a correlation among power-supplied states of the plurality of heating elements.

SUMMARY OF THE INVENTION

There is provided a heating apparatus comprising: a first load; a first switch element configured to switch between power supply from an AC power source to the first load and shut-off of power; a second load; a second switch element configured to switch between power supply from the AC power source to the second load and shut-off of power; a control unit configured to control the first switch element and the second switch element to supply power to either the first load or the second load; a first detection unit configured to detect that the first switch element is in a conductive state or a non-conductive state; a second detection unit configured to detect that the second switch element is in a conductive state or a non-conductive state; and a determination unit configured to determine whether both of the first load and the second load are in a state of being supplied with power, based on a result of detection by the first detection unit and a result of detection by the second detection unit.

Further features of the present invention will become apparent from the following description of exemplary embodiments with reference to the attached drawings.

DESCRIPTION OF THE EMBODIMENTS

Modes for carrying out the present invention are described below in detail based on embodiments with reference to the drawings.

First Embodiment

[Overall Configuration]

Figure 1:
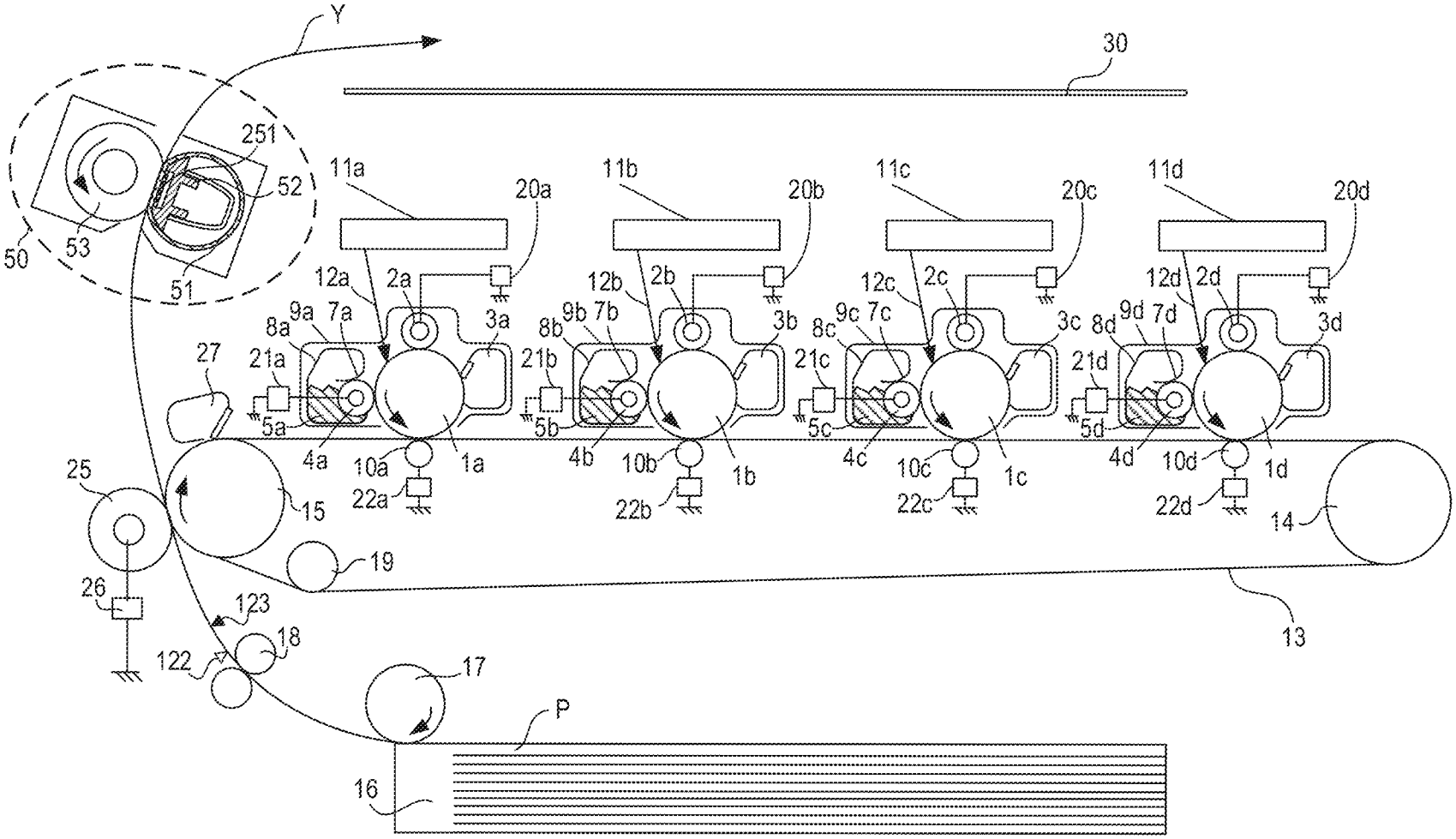
FIG. 1 is a sectional view for illustrating the configuration of an image forming apparatus according to each of first to third embodiments.

FIG. 1 is a configuration view for illustrating an inline-type color image forming apparatus being an image forming apparatus having mounted thereon a fixing apparatus according to a first embodiment as an example. With reference to FIG. 1, an operation of an electrophotographic color image forming apparatus is described. A first station corresponds to a station for forming a toner image of a yellow (Y) color, and a second station corresponds to a station for forming a toner image of a magenta (M) color. Further, a third station corresponds to a station for forming a toner image of a cyan (C) color, and a fourth station corresponds to a station for forming a toner image of a black (K) color.

In the first station, a photosensitive drum 1*a* serving as an image bearing member is an OPC photosensitive drum. The photosensitive drum 1*a* is formed by laminating a plurality of layers of functional organic materials including, for example, a carrier generating layer formed on a metal cylinder to generate charges through light exposure, and a charge transporting layer for transporting the generated charges. The outermost layer has a low electric conductivity and is almost insulated. A charging roller 2*a* serving as a charging unit is brought into abutment against the photosensitive drum 1*a*. The charging roller 2*a* is rotated in association with the rotation of the photosensitive drum 1*a* to uniformly charge the surface of the photosensitive drum 1*a*. The charging roller 2*a* is applied with a voltage on which a DC voltage or an AC voltage is superimposed, and the photosensitive drum 1*a* is charged by causing discharge at minute air gaps on the upstream and the downstream in a rotation direction from a nip portion between the charging roller 2*a* and the surface of the photosensitive drum 1*a*. A cleaning unit 3*a* is a unit configured to remove toner remaining on the photosensitive drum 1*a* after transfer to be described later. A developing unit 8*a* serving as a developing unit includes a developing roller 4*a*, a nonmagnetic one-component toner 5*a*, and a developer applying blade 7*a*. The photosensitive drum 1*a*, the charging roller 2*a*, the cleaning unit 3*a*, and the developing unit 8*a* form an integral process cartridge 9*a* which is removably mounted to the image forming apparatus.

An exposure device 11*a* serving as an exposing unit includes a scanner unit configured to scan laser light by a polygon mirror, or a light emitting diode (LED) array. The exposure device 11*a* radiates a scanning beam 12*a* modulated based on an image signal onto the photosensitive drum 1*a*. Further, the charging roller 2*a* is connected to a charging high-voltage power source 20*a* serving as a voltage supply unit for the charging roller 2*a*. The developing roller 4*a* is connected to a development high-voltage power source 21*a* serving as a voltage supply unit for the developing roller 4*a*. A primary transfer roller 10*a* serving as a transfer unit is connected to a primary transfer high-voltage power source 22*a* serving as a voltage supply unit for the primary transfer roller 10*a*. The configuration of the first station has been described above, and the second, third, and fourth stations also have similar configurations. As for the other stations, components having same functions as those of the first station are denoted by same reference numerals, and the reference numerals are provided with suffixes "b", "c", and "d" for the respective stations. In the following description, the suffixes "a", "b", "c", and "d" are omitted except for a case in which a specific station is described.

An intermediate transfer belt 13 is supported by three rollers of a secondary transfer opposing roller 15, a tension roller 14, and an auxiliary roller 19 serving as stretching members for the intermediate transfer belt 13. Only the tension roller 14 is applied with a force by a spring in a direction of stretching the intermediate transfer belt 13, and thus an appropriate tension force is maintained with respect to the intermediate transfer belt 13. The secondary transfer opposing roller 15 follows the drive of a main motor (not shown) to rotate, and thus the intermediate transfer belt 13 wound around an outer periphery of the secondary transfer opposing roller 15 is rotated. The intermediate transfer belt 13 is moved at a substantially same speed in a forward direction (for example, clockwise direction of FIG. 1) with respect to the photosensitive drums 1*a* to 1*d* (for example, rotation in the counterclockwise direction of FIG. 1). Further, the intermediate transfer belt 13 is rotated in the arrow direction (clockwise direction), and the primary transfer roller 10 is arranged on the opposite side of the photosensitive drum 1 across the intermediate transfer belt 13 so as to rotate in association with the movement of the intermediate transfer belt 13. A position at which the photosensitive drum 1 and the primary transfer roller 10 are brought into abutment against each other across the intermediate transfer belt 13 is referred to as "primary transfer position." The auxiliary roller 19, the tension roller 14, and the secondary transfer opposing roller 15 are electrically grounded. The second to fourth stations have primary transfer rollers 10*b* to 10*d* configured similarly to the primary transfer roller 10*a* of the first station, and hence description thereof is omitted here.

Next, an image forming operation of the image forming apparatus according to the first embodiment is described. When the image forming apparatus receives a printing instruction under a standby state, the image forming apparatus starts the image forming operation. The photosensitive drum 1, the intermediate transfer belt 13, and the like start rotation in the arrow direction at a predetermined process speed by the main motor (not shown). The photosensitive drum 1*a* is uniformly charged by the charging roller 2*a* applied with a voltage by the charging high-voltage power source 20*a*, and subsequently an electrostatic latent image is formed in accordance with image information (also referred to as "image data") by the scanning beam 12*a* radiated from the exposure device 11*a*. The toner 5*a* in the developing unit 8*a* is negatively charged to be applied on the developing roller 4*a* by the developer applying blade 7*a*. Then, the developing roller 4*a* is supplied with a predetermined developing voltage by the development high-voltage power source 21*a*. When the photosensitive drum 1*a* is rotated so that the electrostatic latent image formed on the photosensitive drum 1*a* arrives at the developing roller 4*a*, the negative toner adheres on the electrostatic latent image so as to be visible, and a toner image of a first color (for example, yellow (Y)) is formed on the photosensitive drum 1*a*. The stations of the other colors of magenta (M), cyan (C), and black (K) (process cartridges 9*b* to 9*d*) also operate similarly. A write signal from a controller (not shown) is delayed at a constant timing depending on distances between the primary transfer positions of the respective colors so that electrostatic latent images are formed by exposure on the photosensitive drums 1*a* to 1*d*. The primary transfer rollers 10*a* to 10*d* are each applied with a DC high voltage having a polarity opposite to that of toner. With the above-mentioned steps, toner images are sequentially transferred onto the intermediate transfer belt 13 (hereinafter referred to as "primary transfer"), and thus multi-layered toner images are formed on the intermediate transfer belt 13.

After that, in synchronization with the formation of the toner images, sheets P corresponding to recording materials stacked on a cassette 16 are conveyed along a conveyance path Y. Specifically, the sheet P is fed (picked up) by a sheet feeding roller 17 driven to rotate by a sheet feeding solenoid (not shown). The fed sheet P is conveyed to registration rollers 18 by conveyance rollers. Then, the sheet P passes through a sheet width sensor 122 serving as a detection unit configured to detect a length of the sheet in a direction orthogonal to a conveyance direction (hereinafter referred to as "width"). A registration sensor 123 is arranged on the downstream of the registration rollers 18. The registration sensor 123 detects the "presence" of the sheet P when a leading edge of the sheet P arrives, and detects the "absence" of the sheet P when a trailing edge of the sheet P passes through the registration sensor 123.

The sheet P is conveyed by the registration rollers 18 to a transfer nip portion being an abutment portion between the intermediate transfer belt 13 and a secondary transfer roller 25 in synchronization with the toner images formed on the intermediate transfer belt 13. The secondary transfer roller 25 is applied with a voltage having a polarity opposite to that of the toner by a secondary transfer high-voltage power source 26. Thus, the multi-layered toner images of the four colors borne on the intermediate transfer belt 13 are collectively transferred onto the sheet P (recording material) (hereinafter referred to as "secondary transfer"). Members contributing to the process until the unfixed toner images are formed on the sheet P (for example, the photosensitive drum 1) function as an image forming unit. Meanwhile, after the secondary transfer is finished, toner remaining on the intermediate transfer belt 13 is removed by the cleaning unit 27. The sheet P that has been subjected to the secondary transfer is conveyed to a fixing apparatus 50 serving as a heating apparatus, to thereby be subjected to fixing of the toner images. Then, the sheet P is discharged to a discharge tray 30 as an image-formed object (print or copy). The fixing apparatus 50 includes a film 51 serving as a first rotary member, a nip forming member 52, a pressure roller 53 serving as a second rotary member, and a heater 251. The heater 251 includes a plurality of heating elements to be described later, and the plurality of heating elements are provided to be in contact with an inner surface of the film 51. Further, the pressure roller 53 forms a nip portion together with the film 51, and the nip portion is formed by the plurality of heating elements and the pressure roller 53 via the film 51.

[Circuit Block Diagram]

Figure 2:
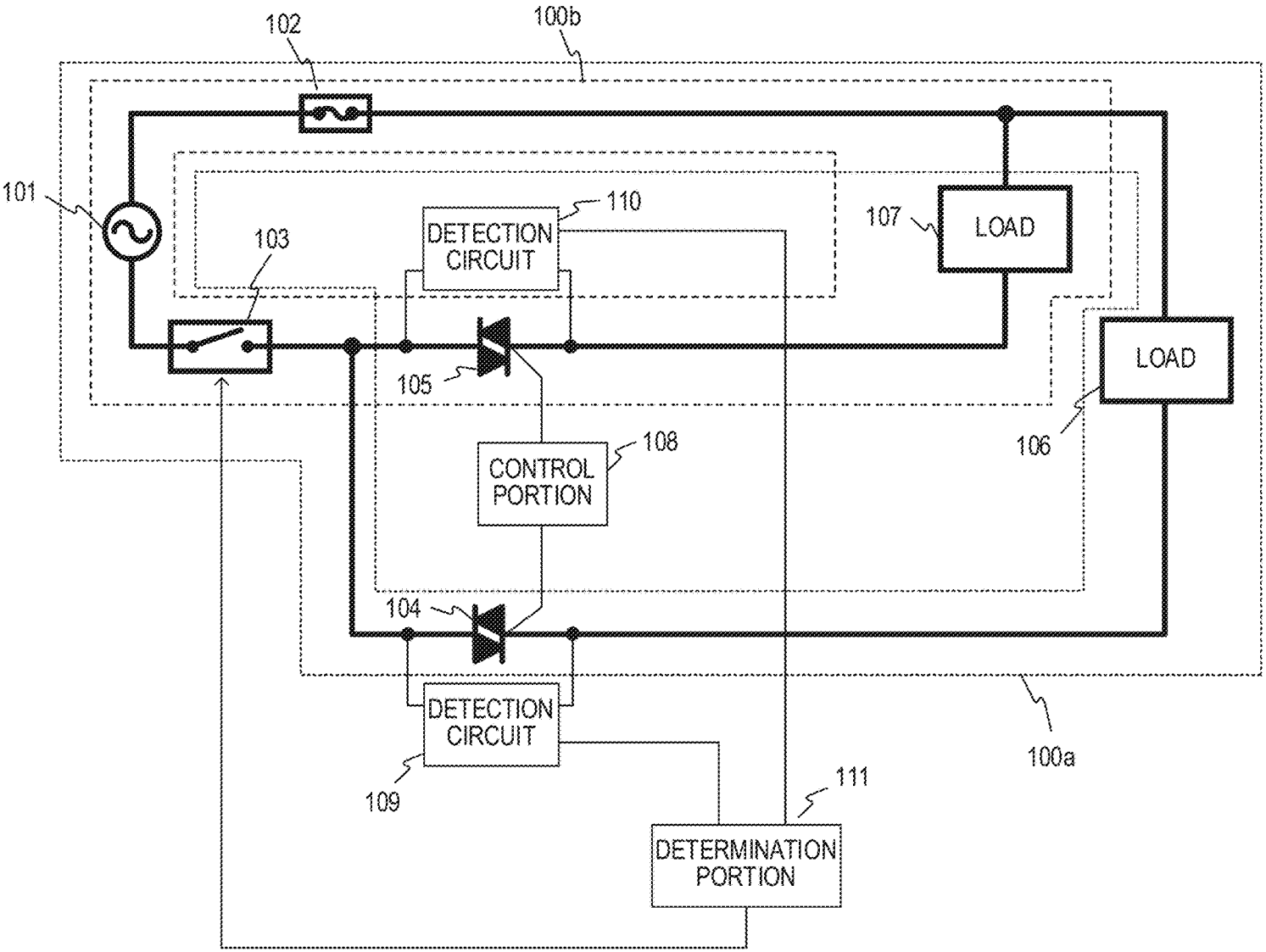
FIG. 2 is a circuit block diagram for illustrating a fixing apparatus in the first embodiment.

FIG. 2 is a circuit block diagram for illustrating the fixing apparatus 50 including an abnormality detector. The fixing apparatus 50 includes a first closed circuit 100*a*, a second closed circuit 100*b*, a control portion 108, a detection circuit 109, a detection circuit 110, and a determination portion 111. The first closed circuit 100*a* includes an AC power source 101, a current fuse 102, a load 106, a bidirectional thyristor (hereinafter referred to as "triac") 104, and an electromagnetic relay 103. The second closed circuit 100*b* includes the AC power source 101, the current fuse 102, a load 107, a triac 105, and the electromagnetic relay 103.

Power supply and shut-off of power from the AC power source 101 to the first load 106 (hereinafter referred to as "load 106") are controlled by controlling the triac 104 being a first switch element to be conductive or non-conductive with the control portion 108 being a control unit. Further, power supply and shut-off of power from the AC power source 101 to the second load 107 (hereinafter referred to as "load 107") are controlled by controlling the triac 105 being a second switch element to be conductive or non-conductive with the control portion 108. In the fixing apparatus 50 in the first embodiment, the control portion 108 controls the triac 104 and the triac 105 so as not to supply power from the AC power source 101 to the load 106 and the load 107 at the same time. A detailed description is given below with reference to FIG. 3.

The detection circuit 109 being a first detection unit is connected in parallel to the triac 104, to thereby detect whether the triac 104 is in a conductive state or a non-conductive state. The detection circuit 110 being a second detection unit is similarly connected in parallel to the triac 105, to thereby detect whether the triac 105 is in a conductive state or in a non-conductive state. Outputs of the detection circuit 109 and the detection circuit 110 are input to the determination portion 111. The determination portion 111 being a determination unit determines such an abnormal state that power is supplied to both of the triac 104 and the triac 105 based on a detection result of the detection circuit 109 and a detection result of the detection circuit 110. Specifically, the determination portion 111 determines whether the triac 104 and the triac 105 are in a conductive state at the same time based on a relative relationship between signals input from the detection circuit 109 and the detection circuit 110. A power supply path for electrically connecting the AC power source 101 and each of the triac 104 and the triac 105 is connected to the electromagnetic relay 103 being a connection unit which is brought into a connected state (conductive state) or a non-connected state (non-conductive state) by the determination portion 111. When determining that both of the triac 104 and the triac 105 are in a conductive state at the same time, the determination portion 111 brings the electromagnetic relay 103 into a non-conductive state, to thereby shut-off power supply from the AC power source 101 to the load 106 and the load 107.

[Details of Detection Circuit]

Figure 3:
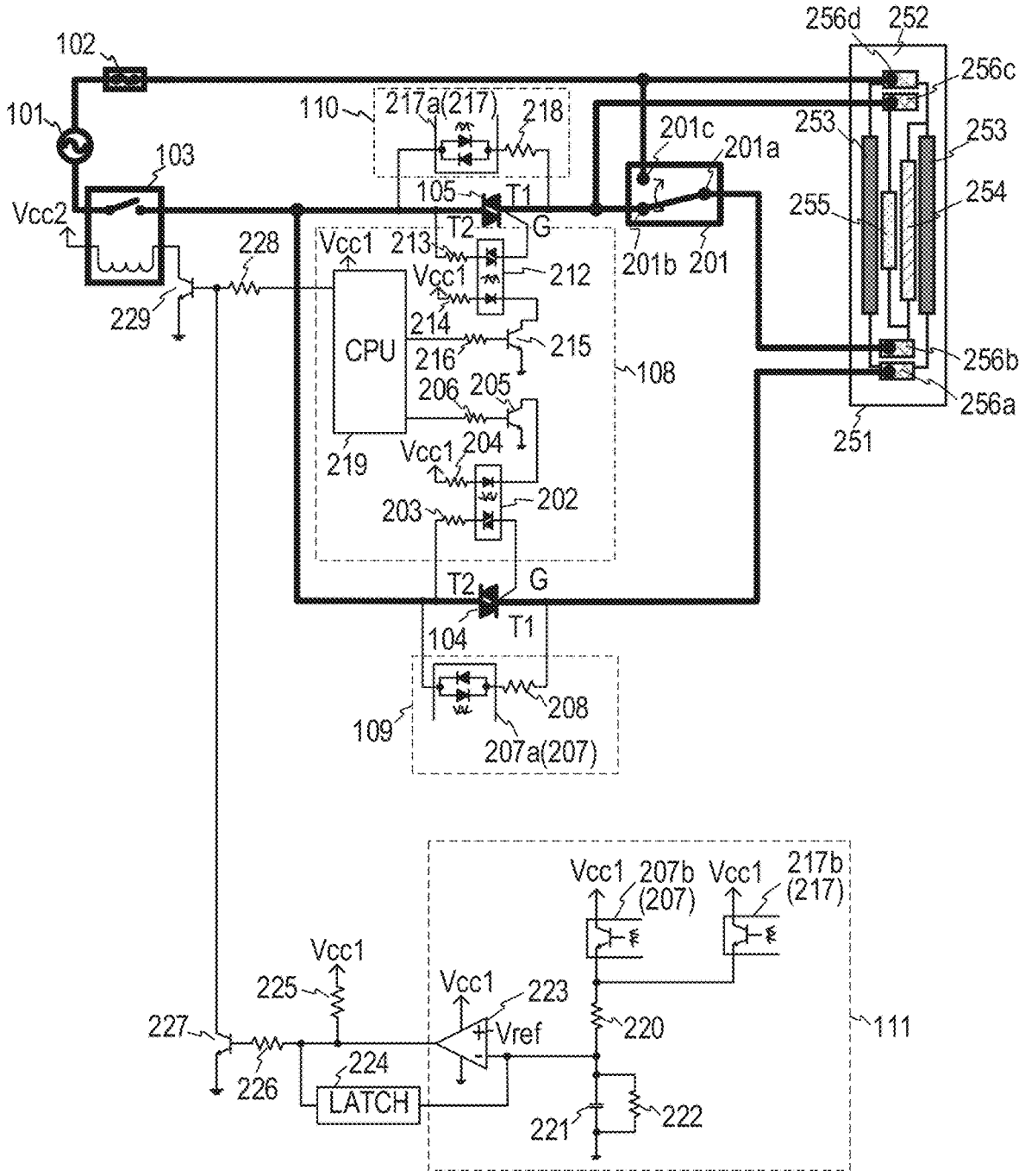
FIG. 3 is a detailed diagram for illustrating the fixing apparatus in the first embodiment.

With reference to FIG. 3, a detailed description is given. The heater 251 is provided in the fixing apparatus 50 of the image forming apparatus according to the first embodiment, and configured to supply heat for fixing the unfixed toner images on the sheet P. The heater 251 includes a ceramic circuit board 252, heating elements 253 being first heating elements, a heating element 254 being a second heating element and a third heating element (third load), a heating element 255 being the second heating element and a fourth heating element (fourth load), and contacts 256*a* to 256*d*. The heating elements 253 correspond to the load 106 illustrated in FIG. 2. The heating elements 253 include two heating elements of substantially the same length in a longitudinal direction, which are connected in parallel to each other. The heating elements 253 are supplied with power from the AC power source 101 via the contact 256*a* and the contact 256*d*. The heating element 254 and the heating element 255 correspond to the load 107 illustrated in FIG. 2. A length in the longitudinal direction of each heating element 253 is longer than that of the heating element 254, and a length in the longitudinal direction of the heating element 255 is shorter than that of the heating element 254. The heating element 254 is supplied with power from the AC power source 101 via the contact 256*b* and the contact 256*d*. The heating element 255 is supplied with power from the AC power source 101 via the contact 256*b* and the contact 256*c*.

On the ceramic circuit board 252, the heating elements 253, the heating element 254, and the heating element 255 are arranged. One of the heating elements 253 is provided at one end portion in a short direction of the ceramic circuit board 252, and the other of the heating elements 253 is provided at the other end portion in the short direction of the ceramic circuit board 252. In the short direction, the one heating element 253, the heating element 254, the heating element 255, and the other heating element 253 are arranged in the stated order. To the contact 256*a* being a first contact, one ends of the one heating element 253 and the other heating element 253 are electrically connected. To the contact 256*d* being a second contact, the other end portions of the one heating element 253, the other heating element 253, and the heating element 254 are electrically connected. To the contact 256*b* being a third contact, one end portions of the heating element 254 and the heating element 255 are electrically connected. To the contact 256*c* being a fourth contact, the other end portion of the heating element 255 is electrically connected.

Any one of the heating element 254 and the heating element 255 is selected by a C-contact relay 201 when in use. The C-contact relay 201 being a switching unit is configured to switch between a power supply path from the AC power source 101 to the heating element 254 and a power supply path from the AC power source 101 to the heating element 255. The C-contact relay 201 includes contacts 201*a*. 201*b*, and 201*c*. When the contact 201*a* and the contact 201*b* of the C-contact relay 201 are connected to each other, the heating element 255 is brought into a short-circuited state by the C-contact relay 201. With this, the heating element 254 is selected as the load of the triac 105. Meanwhile, when the contact 201*a* and the contact 201*c* of the C-contact relay 201 are connected to each other, the heating element 254 is brought into a short-circuited state by the C-contact relay 201. With this, the heating element 255 is selected as the load of the triac 105. As described above, the C-contact relay 201 is controlled by the control portion 108 so that the heating element 254 or the heating element 255 is selected when in use as the load 107 of FIG. 2 as appropriate in accordance with the length in the direction orthogonal to the conveyance direction of the sheet P.

The triac 104 is controlled by a CPU 219 provided inside the control portion 108. In a case of controlling a T1 terminal and a T2 terminal of the triac 104 to be in a conductive state, the CPU 219 executes control to supply a base current to a transistor 205 via a current limiting resistor 206, to thereby bring a collector and an emitter of the transistor 205 into a conductive state. When the collector and the emitter of the transistor 205 are brought into a conductive state, an electric current flows from a power source Vcc1 to a light emitting diode of a solid state relay (hereinafter referred to as "SSR") 202 via a current limiting resistor 204. Then, a light receiving portion of the SSR 202 is brought into a conductive state. When the light receiving portion of the SSR 202 is brought into a conductive state, a gate current is supplied from the AC power source 101 to a gate terminal (G terminal) of the triac 104 via a current limiting resistor 203. Then, the T1 terminal and the T2 terminal of the triac 104 are brought into a conductive state. In this example, the power source Vcc1 is a DC power source having a secondary side potential of, for example, 3.3 V (potential insulated from the AC power source 101).

The triac 105 is similarly controlled by the CPU 219. In a case of controlling a T1 terminal and a T2 terminal of the triac 105 into a conductive state, the CPU 219 executes control to supply a base current to a transistor 215 via a current limiting resistor 216, to thereby bring a collector and an emitter of the transistor 215 into a conductive state. When the collector and the emitter of the transistor 215 are brought into a conductive state, an electric current flows from the power source Vcc1 to a light emitting diode of an SSR 212 via a current limiting resistor 214. Then, a light receiving portion of the SSR 212 is brought into a conductive state. When the light receiving portion of the SSR 212 is brought into a conductive state, a gate current is supplied from the AC power source 101 to a G terminal of the triac 105 via a current limiting resistor 213. Then, the T1 terminal and the T2 terminal of the triac 105 are brought into a conductive state.

In this example, the triac 104 and the triac 105 are controlled by the CPU 219 not to be brought into a conductive state at the same time. This is because three kinds of heating elements in the heater 251, that is, the heating elements 253, 254, and 255 are exclusively selected when in use in accordance with a target sheet width in order to achieve uniform heat distribution in the longitudinal direction of the heater 251. The sheet width refers to a length of the sheet P in a direction parallel to the longitudinal direction of the heating elements 253, 254, and 255, specifically, the length in the direction orthogonal to the conveyance direction of the sheet P. For example, at a timing at which a B5 size sheet passes through the fixing apparatus 50, the control portion 108 executes control so that the heating elements 253 and the heating element 254 alternately generate heat. The heater 251 is designed on the assumption that the heating elements 253, 254, and 255 are exclusively supplied with power. Hence, when the heater 251 remains in such a state that the plurality of heating elements 253, 254, and 255 generate heat at the same time, the heater 251 may cause excessive temperature rise and thus be broken. To address this, the CPU 219 controls the triac 104 and the triac 105 so as to excessively supply power to the heating elements 253, 254, and 255.

When the electromagnetic relay 103 is not required to supply power to the heater 251 (for example, in a case in which the image forming apparatus is in a sleep mode), its contact is set to a non-conductive state in order to improve safety and save power. The electromagnetic relay 103 is controlled by the CPU 219 as with the triacs 104 and 105. The CPU 219 executes control to supply a base current to a transistor 229 via a current limiting resistor 228, to thereby bring a collector and an emitter of the transistor 229 into a conductive state, and cause an electric current to flow from a power source Vcc2 to a coil of the electromagnetic relay 103. In this way, the contact of the electromagnetic relay 103 is brought into a conductive state.

(Detection Circuit)

Next, the detection circuit 109 and the detection circuit 110 configured to detect conductive states of the triacs 104 and 105, respectively, are described. The detection circuit 109 is connected in parallel to between the T1 terminal and the T2 terminal of the triac 104. First, description is given of a case in which the T1 terminal and the T2 terminal of the triac 104 are in a non-conductive state. In this case, an electric current flows from the AC power source 101 via a current limiting resistor 208 to a light emitting portion 207*a* of a photocoupler (hereinafter referred to as "AC photocoupler") 207 that is adapted to an alternating current independent of a polarity of the AC power source 101 (whether with a positive half wave or with a negative half wave). As a result, a collector and an emitter of a light receiving transistor 207*b* of the AC photocoupler 207 are brought into a conductive state. Meanwhile, when the T1 terminal and the T2 terminal of the triac 104 are in a conductive state, the light emitting portion 207*a* of the AC photocoupler 207 does not emit light independent of the polarity of the AC power source 101. Thus, the collector and the emitter of the light receiving transistor 207*b* of the AC photocoupler 207 are brought into a non-conductive state.

The detection circuit 110 is connected in parallel to between the T1 terminal and the T2 terminal of the triac 105. First, description is given of a case in which the T1 terminal and the T2 terminal of the triac 105 are in a non-conductive state. In this case, an electric current flows from the AC power source 101 via a current limiting resistor 218 to a light emitting portion 217*a* of an AC photocoupler 217 independent of the polarity of the AC power source 101. As a result, a collector and an emitter of a light receiving transistor 217*b* of the AC photocoupler 217 are brought into a conductive state. Meanwhile, when the T1 terminal and the T2 terminal of the triac 105 are in a conductive state, the light emitting portion 217*a* of the AC photocoupler 217 does not emit light independent of the polarity of the AC power source 101. Thus, the collector and the emitter of the light receiving transistor 217*b* of the AC photocoupler 217 are brought into a non-conductive state. As described above, the detection circuits 109 and 110 include the light emitting portions 207*a* and 217*a* on the primary side, and the light receiving transistors 207*b* and 217*b* on the secondary side, respectively. The detection circuits 109 and 110 are configured to insulate and convert voltage information on the primary side that is not insulated from the AC power source 101 into a signal on the secondary side, and then output the converted signal to the determination portion 111 on the secondary side.

(Determination Portion)

Next, the determination portion 111 is described. The light receiving transistor 207*b* of the AC photocoupler 207 and the light receiving transistor 217*b* of the AC photocoupler 217 are connected in parallel to each other. Both of the emitter terminal of the light receiving transistor 207*b* of the AC photocoupler 207 and the emitter terminal of the light receiving transistor 217*b* of the AC photocoupler 217 are connected to one end of a resistor 220. A voltage across both ends of a capacitor 221 is controlled with the use of a charge current from the other end of the resistor 220 and a discharge current of a resistor 222 connected in parallel to the capacitor 221. When one or both of the light receiving transistor 207*b* of the AC photocoupler 207 and the light receiving transistor 217*b* of the AC photocoupler 217 are brought into a conductive state, the capacitor 221 is charged by the power source Vcc1 via the resistor 220. The voltage across both ends of capacitor 221 is input to an inverting input terminal (negative terminal) of a comparator 223 to be compared with a reference voltage Vref input to a non-inverting input terminal (positive terminal) of the comparator 223.

An output terminal of the comparator 223 is connected to a base terminal of a transistor 227 via a resistor 226. The transistor 227 is also connected to the power source Vcc1 via a resistor 225 and the resistor 226. A latch circuit (illustrated as "LATCH") 224 is connected between the inverting input terminal of the comparator 223 and a connection point between the resistor 225 and the resistor 226.

Figure 4:
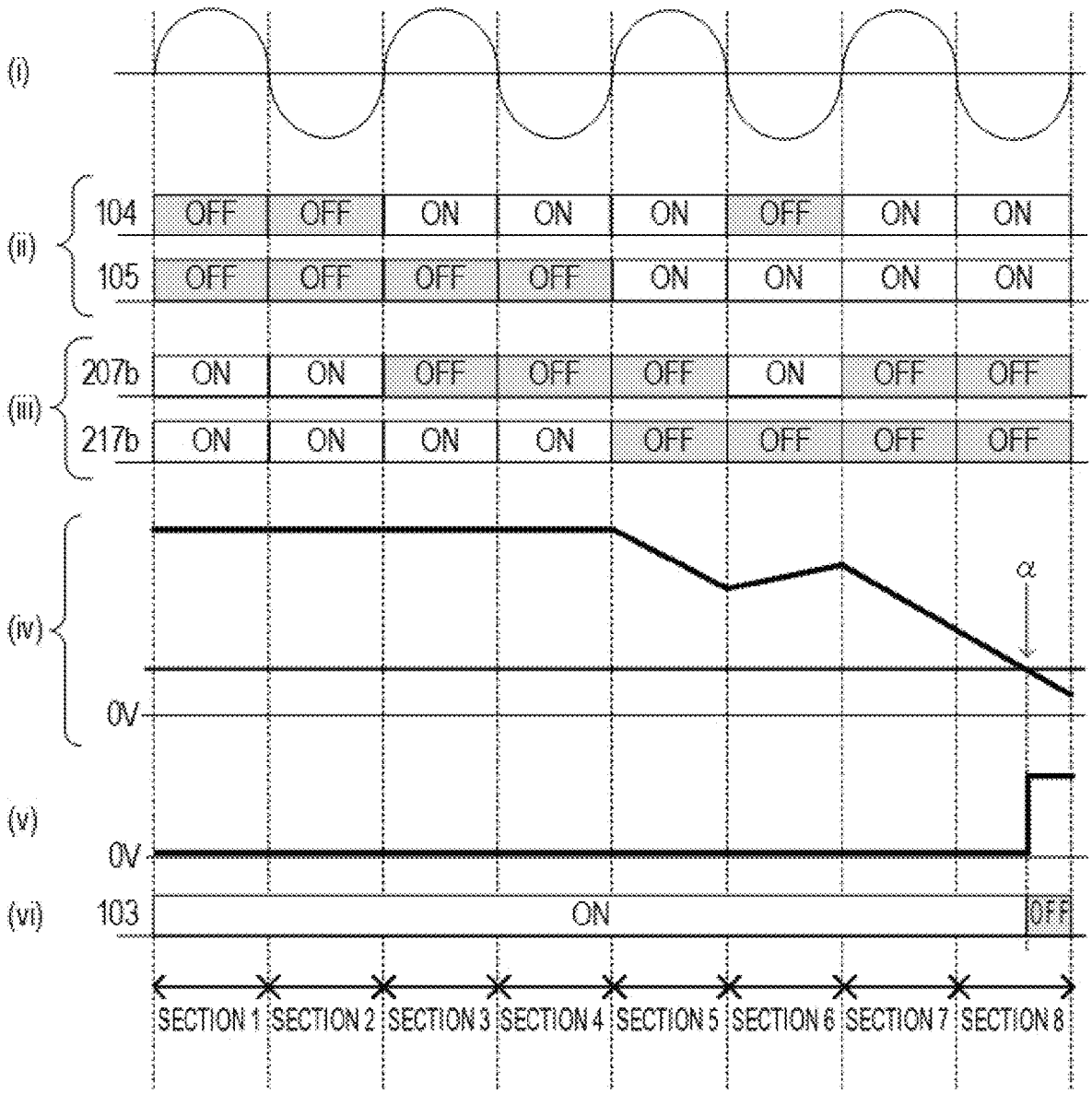
FIG. 4 is a sequence chart for showing an operation of a determination portion in the first embodiment.

With reference to FIG. 3, Table 1, and FIG. 4, an operation of the determination portion 111 is described in detail.

hold "Light on" for a case in which the light emitting portions 207*a* and 217*a* of the detection circuits 109 and 110 emit light, and "Light off" for a case in which the light emitting portions 207*a* and 217*a* of the detection circuits 109 and 110 do not emit light, respectively.

Here, under such a state that power is supplied from the AC power source 101, State A in which both of the triac 104 and the triac 105 are in a non-conductive state, and State B and State C in which any one of the triac 104 and the triac 105 is in the non-conductive state, are defined as a normal state. On the other hand, under such a state that power is supplied from the AC power source 101, State D in which both of the triac 104 and the triac 105 are in a conductive state is defined as an abnormal state.

[Operation of Determination Portion]

With reference to FIG. 4, description is given on the assumption that a half wave period of the AC power source 101 corresponds to one unit of the operation of the determination portion 111, and the operation is divided into Section 1 to Section 8. Part (i) of FIG. 4 shows a voltage waveform of the AC power source 101. Part (ii) of FIG. 4 shows the conductive state between the T1 terminal and the T2 terminal of the triac 104 in its upper portion, and shows the conductive state between the T1 terminal and the T2 terminal of the triac 105 in its lower portion. The conductive state is indicated by "ON" or "OFF" as in Table 1. Part (iii) of FIG. 4 shows a conductive state (ON) and a non-conductive state (OFF) of the light receiving transistor 207*b* of the AC photocoupler 207 in its upper portion, and shows a conductive state (ON) and a non-conductive state (OFF) of the light receiving transistor 217*b* of the AC photocoupler 217 in its lower portion. Part (iv) of FIG. 4 shows a voltage of the inverting input terminal of the comparator 223 (thick line) and a voltage (reference voltage Vref) of the non-inverting input terminal (thin line). Part (v) of FIG. 4 shows a voltage of the output terminal of the comparator 223, and part (vi) of FIG. 4 shows a state of the contact of the electromagnetic relay 103 (connected (ON) and disconnected (OFF)).

TABLE 1

| State | Power supply from AC power source 101 to apparatus | Conductive state between T1 terminal and T2 terminal of triac 104 | Conductive state between T1 terminal and T2 terminal of triac 105 | Light emitting portion 207a of detection circuit 109 | Light emitting portion 217a of detection circuit 110 |
|---|---|---|---|---|---|
| State A | ON | OFF | OFF | Light on | Light on |
| State B | ON | ON | OFF | Light off | Light on |
| State C | ON | OFF | ON | Light on | Light off |
| State D | ON | ON | ON | Light off | Light off |
| State E | OFF | — | — | Light off | Light off |

Table 1 shows a state in a first column, power supply from the AC power source 101 to the fixing apparatus 50 in a second column, and a conductive state between the T1 terminal and the T2 terminal of the triac 104 in a third column. Table 1 also shows a conductive state between the T1 terminal and the T2 terminal of the triac 105 in a fourth column, a state of the light emitting portion 207*a* of the detection circuit 109 in a fifth column, and a state of the light emitting portion 217*a* of the detection circuit 110 in a sixth column. Here, the first column holds the states of State A to State E. The second column holds ON for a case in which power is supplied from the AC power source 101 to the fixing apparatus 50, and OFF for a case in which power supply is stopped. The ON/OFF of the power supply is controlled by the control portion 108 controlling the electromagnetic relay 103 to be in a conductive state/non-conductive state. The third column and the fourth column hold ON for the conductive state of the triacs 104 and 105, and OFF for the non-conductive state of the triacs 104 and 105, respectively. The fifth column and the sixth column <Section 1 and Section 2>

In Section 1 and Section 2, the T1 terminal and the T2 terminal are in a non-conductive state (OFF) in both of the triac 104 and the triac 105. Thus, both of the collector and the emitter of the light receiving transistor 207*b* of the AC photocoupler 207 and the collector and the emitter of the light receiving transistor 217*b* of the AC photocoupler 217 are brought into a conductive state (ON) (State A). With this, the capacitor 221 of the determination portion 111 is charged by the power source Vcc1 via the resistor 220. In this example, a resistance value of the resistor 220 is set smaller than that of the resistor 222. Thus, under a state in which the charge current is supplied to the capacitor 221 from the power source Vcc1 via the resistor 220, a relationship of (charge current)>(discharge current) is established. As a result, in Section 1 and Section 2, the voltage across both ends of the capacitor 221, that is, the voltage of the inverting input terminal of the comparator 223 is increased or fully charged. FIG. 4 shows that the capacitor 221 is in a fully charged state in Section 1 and Section 2.

In Section 1 and Section 2, the voltage of the inverting input terminal of the comparator 223 is higher than the voltage (reference voltage Vref) of the non-inverting input terminal. Thus, an output transistor (not shown) of the comparator 223 is turned ON so that the voltage of the output terminal of the comparator 223 becomes almost a ground (hereinafter referred to as "GND") potential (0 V). With this, almost all of an electric current supplied from the power source Vcc1 via the resistor 225 is sunk to the output terminal of the comparator 223. Thus, a base current is not supplied to the transistor 227 so that the collector and the emitter of the transistor 227 are brought into a non-conductive state. As a result, in Section 1 and Section 2, the contact of the electromagnetic relay 103 is brought into a conductive state or a non-conductive state under the control of the CPU 219. In FIG. 4, the CPU 219 controls the electromagnetic relay 103 to be in a connected state (conductive state) (ON).

<Section 3 and Section 4>

Next, in Section 3 and Section 4, the T1 terminal and the T2 terminal of the triac 104 are in a conductive state (ON), and the T1 terminal and the T2 terminal of the triac 105 are in a non-conductive state (OFF). Under this state, the collector and the emitter of the light receiving transistor 207*b* of the AC photocoupler 207 are brought into a non-conductive state (OFF), and the collector and the emitter of the light receiving transistor 217*b* of the AC photocoupler 217 are brought into a conductive state (ON) (State B). With this, the capacitor 221 is charged by the power source Vcc1 via the light receiving transistor 217*b* of the AC photocoupler 217 and the resistor 220, and the voltage across both ends of the capacitor 221 is increased or fully charged. FIG. 4 shows that the capacitor 221 is in a fully charged state in Section 3 and Section 4. In Section 3 and Section 4, the voltage of the inverting input terminal of the comparator 223 is higher than the voltage of the non-inverting input terminal. Thus, the output transistor (not shown) of the comparator 223 is kept ON, and the contact of the electromagnetic relay 103 is maintained in a conductive state (ON).

<Section 5>

In Section 5, the T1 terminal and the T2 terminal are in a conductive state (ON) in both of the triac 104 and the triac 105. This condition means that the apparatus is not normally controlled. The CPU 219 executes control not to supply power to the triac 104 and the triac 105 at the same time. Thus, a state in which the T1 terminal and the T2 terminal are in a conductive state (ON) in both of the triac 104 and the triac 105, suggests the occurrence of some defect. The following case is conceivable as an example of the defect. That is, external surge, for example, is input to the apparatus via the AC power source 101, to thereby cause an erroneous operation of the triacs 104 and 105 (erroneous conduction between the T1 terminal and the T2 terminal).

In Section 5, the T1 terminal and the T2 terminal are in a conductive state (ON) in both of the triac 104 and the triac 105. Both of the collector and the emitter of the light receiving transistor 207*b* of the AC photocoupler 207 and the collector and the emitter of the light receiving transistor 217*b* of the AC photocoupler 217 are brought into a non-conductive state (OFF) (State D). The state in which both of the triac 104 and the triac 105 are in a conductive state is hereinafter referred to as "simultaneous conductive state." Under this state, charges of the capacitor 221 are released via the resistor 222, and the voltage across both ends of the capacitor 221 (voltage of the inverting input terminal of the comparator 223) is reduced. In Section 5, the voltage of the inverting input terminal of the comparator 223 is reduced but does not fall below the reference voltage Vref of the non-inverting input terminal of the comparator 223. Thus, the output transistor (not shown) of the comparator 223 is kept ON, and the contact of the electromagnetic relay 103 is maintained in a conductive state (ON).

The determination portion 111 does not confirm the simultaneous conductive state of the triacs 104 and 105 when the simultaneous conductive state of the triac 104 and the triac 105 continues a short time for the following reason. That is, the reason is to balance an erroneous operation caused by external surge and the risk of the plurality of heating elements 253, 254, and 255 generating heat at the same time to cause excessive temperature rise of the heater 251. In other words, the following case is considered: under such a short-time simultaneous conductive state that no defect occurs even when the plurality of heating elements 253, 254, and 255 generate heat at the same time, the triacs 104 and 105 temporarily operate erroneously (erroneous conduction between the T1 terminal and the T2 terminal) due to external surge, for example. The determination portion Ill is set to have redundancy in its determination as to such a temporal erroneous operation, so as not to stop the apparatus. The above-mentioned "short time" refers to one half wave period of the AC power source 101 in the first embodiment.

<Section 6>

In Section 6, the T1 terminal and the T2 terminal of the triac 104 are in a non-conductive state (OFF), and the T1 terminal and the T2 terminal of the triac 105 are in a conductive state (ON). Under this state, the light receiving transistor 207*b* of the AC photocoupler 207 is brought into a conductive state (ON), and the light receiving transistor 217*b* of the AC photocoupler 217 is brought into a non-conductive state (OFF) (State C). With this, the capacitor 221 is charged by the power source Vcc1 via the light receiving transistor 207*b* of the AC photocoupler 207 and the resistor 220. In Section 5, the voltage of the inverting input terminal of the comparator 223 is reduced due to a temporal erroneous operation, and thus the voltage of the inverting input terminal of the comparator 223 is increased in Section 6. The voltage of the inverting input terminal of the comparator 223 is higher than the voltage (reference voltage Vref) of the non-inverting input terminal of the comparator 223, and thus the output transistor (not shown) of the comparator 223 is kept ON, and the contact of the electromagnetic relay 103 is maintained in a conductive state (ON).

<Section 7 and Section 8>

In Section 7 and Section 8, a period in which the T1 terminal and the T2 terminal are in a conductive state (ON) in both of the triac 104 and the triac 105 (State D) continues for two half wave periods of the AC power source 101. In Section 7, the voltage of the inverting input terminal of the comparator 223 continues to lower, and at a timing "a" in Section 8, the voltage of the inverting input terminal of the comparator 223 falls below the reference voltage Vref of the non-inverting input terminal of the comparator 223. The determination portion 111 determines that the simultaneous conductive state of the triac 104 and the triac 105 is confirmed at the timing "a".

When the voltage of the inverting input terminal of the comparator 223 falls below the reference voltage Vref of the non-inverting input terminal of the comparator 223, the output transistor (not shown) of the comparator 223 is turned OFF so that an output of the comparator 223 is brought into a high-impedance (Hiz) state. Then, a base current is supplied from the power source Vcc1 via the resistor 225 and resistor 226 to the transistor 227. The collector and the emitter of the transistor 227 supplied with the base current are brought into a conductive state, and then an electric current supplied from the CPU 219 to the transistor 229 is sunk by the transistor 227 via the resistor 228. Thus, the collector and the emitter of the transistor 229 are brought into a non-conductive state, and the contact of the electromagnetic relay 103 is brought into a non-conductive state, to thereby shut-off power supply from the AC power source 101 to the heater 251. As described above, when the output terminal of the comparator 223 is at high impedance, in other words, when the determination portion 11 determines that the triacs 104 and 105 are in the simultaneous conductive state, the electromagnetic relay 103 is brought into a non-conductive state (OFF) independent of control of the control portion 108.

Here, once the determination portion 111 confirms the simultaneous conductive state of the triac 104 and the triac 105, the latch circuit 224 functions to maintain the contact of the electromagnetic relay 103 in a non-connected state even in a case in which the simultaneous conductive state is canceled later. Once the voltage of the inverting input terminal of the comparator 223 becomes lower than the reference voltage Vref of the non-inverting input terminal, and the output of the comparator 223 is at high impedance (Hiz), the latch circuit 224 operates as follows. That is, the latch circuit 224 maintains the voltage of the inverting input terminal of the comparator 223 to be lower than the reference voltage Vref of the non-inverting input terminal. Here, the function of the latch circuit 224 is not an essential part of the present invention. Thus, it is desirable to determine, for each apparatus, settings as to whether the circuit is of a latch type or an automatic recovery type that causes the contact of the electromagnetic relay 103 to return to a conductive state when the simultaneous conductive state of the triac 104 and the triac 105 is canceled, for example.

Further, in the first embodiment, the description is given of an example in which the determination portion 111 confirms the simultaneous conductive state of the triac 104 and the triac 105 when the simultaneous conductive state of the triac 104 and the triac 105 continues for two half wave periods of the AC power source 101. However, a time period required for the determination portion 1/1 to confirm the determination (hereinafter referred to as "determination confirmation time period") is not limited to two half wave periods of the AC power source 101. Specifically, from the viewpoint of ensuring redundancy when there is an influence of external surge, for example, it is desirable to set a longer determination confirmation time period for the determination portion 111. Meanwhile, from the viewpoint of preventing such a situation that the plurality of heating elements generate heat at the same time, to thereby cause excessive temperature rise of the heater 251, it is desirable to set a shorter determination confirmation time period for the determination portion 111. It is accordingly required to set, for each apparatus, an appropriate determination confirmation time period for the determination portion 111 in consideration of both of the viewpoints.

Further, as shown in Table 1, the configuration of the first embodiment cannot distinguish State D (T1 and T2 terminals of both of the triac 104 and the triac 105 are in a conductive state) and State E (power supply from the AC power source 101 to the apparatus is OFF) from each other. As a result, in a case of instantaneous power failure of the AC power source 101, for example, the determination portion 111 is required not to erroneously confirm a simultaneous conductive state of a plurality of triacs. To that end, it is required to set the determination confirmation time period of the determination portion 111 to be longer than the instantaneous power failure time period estimated in the apparatus, through increasing a discharge time constant defined by the capacitor 221 and the resistor 222, for example. As described above, the time period required for the determination portion 111 to determine and confirm the simultaneous conductive state of the plurality of triacs is desirably set so as to deal with a plurality conditions such as instantaneous power failure, external surge, and excessive power supply to a load.

As described above, according to the first embodiment, an accuracy in failure determination of the heating apparatus configured to exclusively supply power to the plurality of heating elements can be improved.

Second Embodiment

[Circuit Block Diagram]

Figure 5:
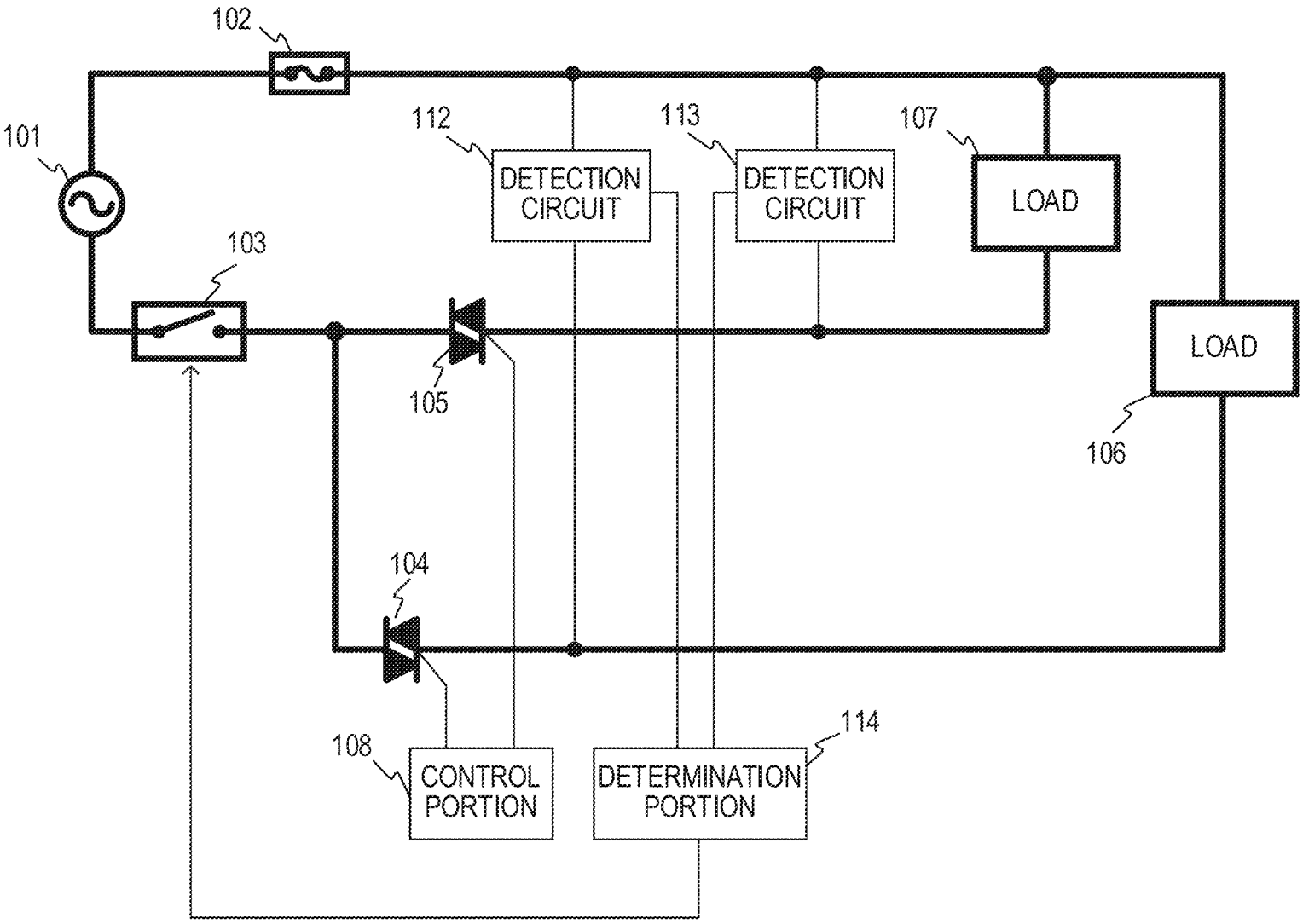
FIG. 5 is a circuit block diagram for illustrating a fixing apparatus in the second embodiment.
Figure 6:
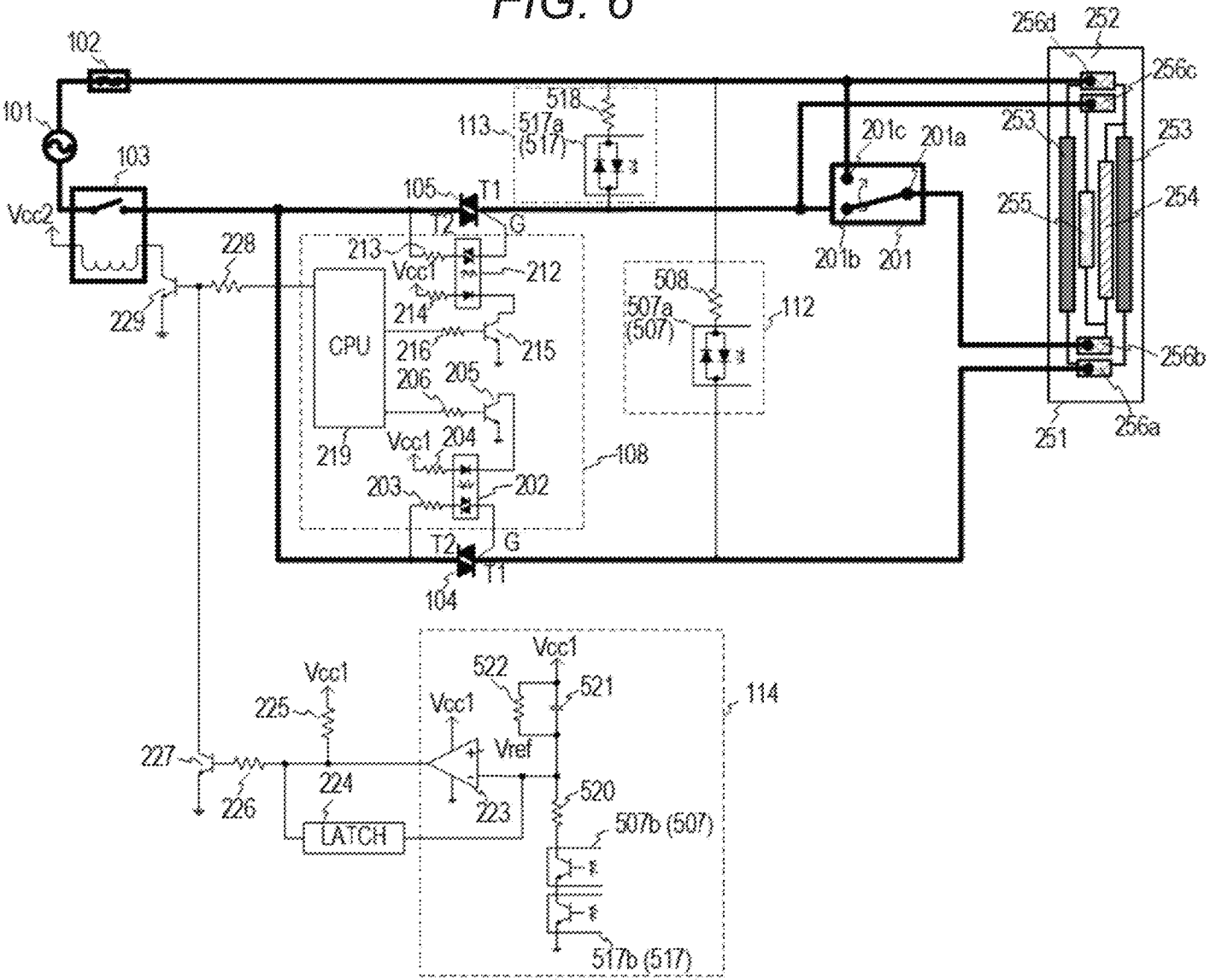
FIG. 6 is a detailed diagram for illustrating the fixing apparatus in the second embodiment.
Figure 7:
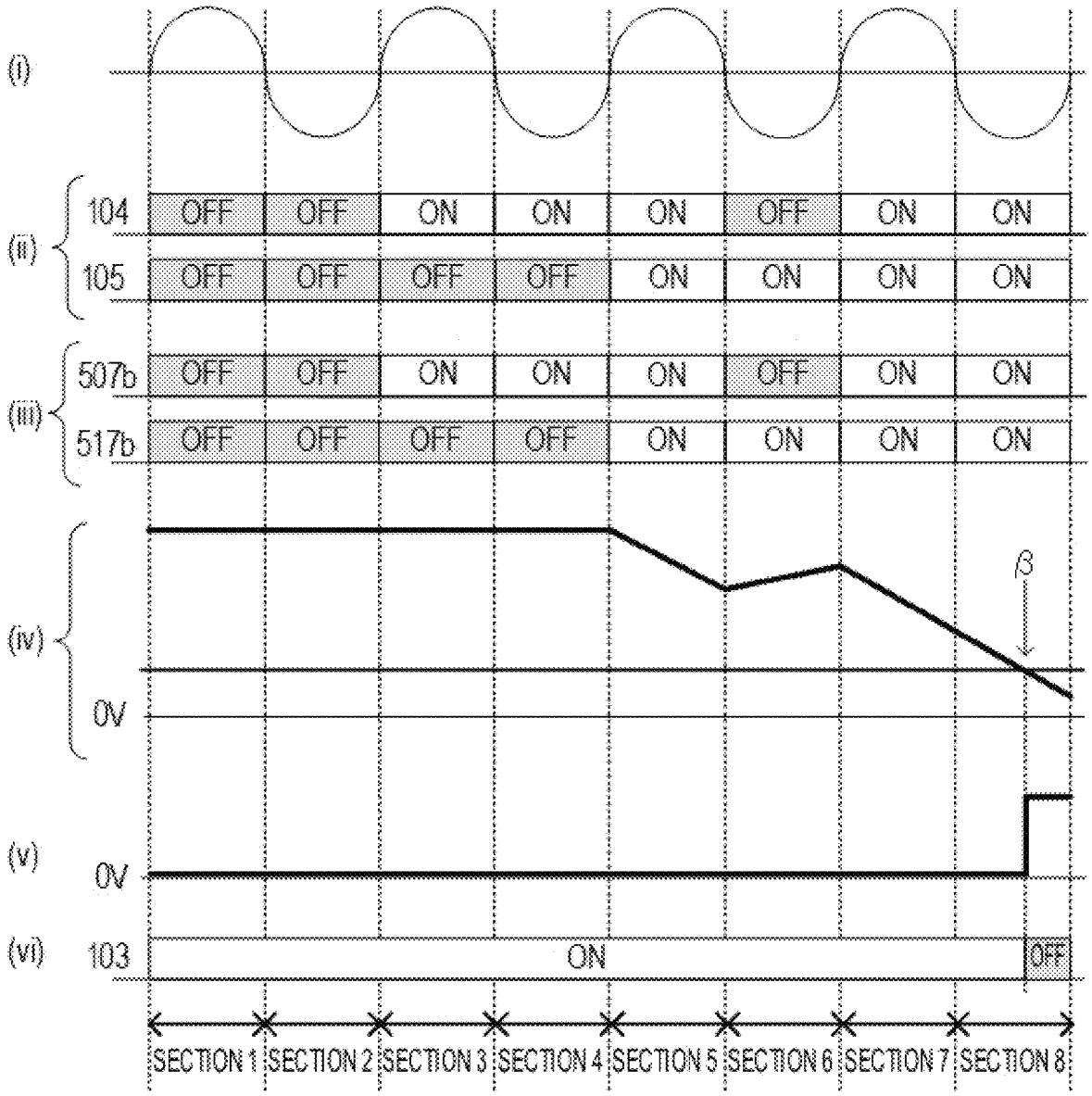
FIG. 7 is a sequence chart for showing an operation of a determination portion in the second embodiment.

With reference to FIG. 5 to FIG. 7, the configuration of a second embodiment is described. FIG. 5 is a circuit block diagram for illustrating an image forming apparatus. FIG. 6 is detailed illustration of the circuit. In FIG. 5 and FIG. 6, components that overlap with the components described in the first embodiment are denoted by identical reference symbols, and descriptions thereof are omitted. As illustrated in FIG. 5, the second embodiment is different from the first embodiment in layout of a detection circuit 112 and a detection circuit 113. In the first embodiment, the detection circuit 109 is connected in parallel to between the T1 terminal and the T2 terminal of the triac 104, and the detection circuit 110 is connected in parallel to between the T1 terminal and the T2 terminal of the triac 105. Meanwhile, in the second embodiment, the detection circuit 112 is connected in series to the triac 104, and the detection circuit 113 is connected in series to the triac 105. Through the series-connection of the detection circuit 112 (113) to the triac 104 (105), a case of the plurality of triacs 104 and 105 being in the simultaneous conductive state and a case of power supply from the AC power source 101 being shut-off can be distinguished from each other.

[Details of Detection Circuit]

(Detection Circuit)

With reference to FIG. 6, the detection circuit 112 and the detection circuit 113 configured to detect conductive states of the triacs 104 and 105, respectively, are described. The detection circuit 112 is connected in series to between the T1 terminal and the T2 terminal of the triac 104. In a case of the T1 terminal and the T2 terminal of the triac 104 being in a non-conductive state, a light emitting portion 507*a* of an AC photocoupler 507 does not emit light, and a collector and an emitter of a light receiving transistor 507*b* of the AC photocoupler 507 are brought into a non-conductive state. Meanwhile, when the T1 terminal and the T2 terminal of the triac 104 are in a conductive state, an electric current flows from the AC power source 101 via a current limiting resistor 508 so that the light emitting portion 507*a* of the AC photocoupler 507 emits light. As a result, the collector and the emitter of the light receiving transistor 507*b* of the AC photocoupler 507 are brought into a conductive state.

The detection circuit 113 is connected in series to between the T1 terminal and the T2 terminal of the triac 105. In a case of the T1 terminal and the T2 terminal of the triac 105 being in a non-conductive state, a light emitting portion 517*a* of an AC photocoupler 517 does not emit light, and a collector and an emitter of a light receiving transistor 517*b* of the AC photocoupler 517 are brought into a non-conductive state. Meanwhile, when the T1 terminal and the T2 terminal of the triac 105 are in a conductive state, an electric current flows from the AC power source 101 via a current limiting resistor 518 so that the light emitting portion 517*a* of the AC photocoupler 517 emits light. As a result, the collector and the emitter of the light receiving transistor 517*b* of the AC photocoupler 517 are brought into a conductive state.

(Determination Portion)

A determination portion 114 illustrated in FIG. 6 is described. In the determination portion 114, the power source Vcc1 is connected in series to parallel-connected capacitor 521 and resistor 522, and to a resistor 520. The resistor 522 is provided to charge the capacitor 521, and the resistor 520 is provided to discharge the capacitor 521. In the determination portion 114, the light receiving transistor 507*b* of the AC photocoupler 507 and the light receiving transistor 517*b* of the AC photocoupler 517 are connected in series between the resistor 520 and the ground. Only when both of the collector and the emitter of the light receiving transistor 507*b* of the AC photocoupler 507 and the collector and the emitter of the light receiving transistor 517*b* of the AC photocoupler 517 are in a conductive state, charges of the capacitor 521 are released via the resistor 520.

Meanwhile, when any one of the collector and the emitter of the light receiving transistor 507*b* of the AC photocoupler 507 and the collector and the emitter of the light receiving transistor 517*b* of the AC photocoupler 517 are in a non-conductive state, the capacitor 521 is charged by the power source Vcc1 via the resistor 522. Further, when both of the collector and the emitter of the light receiving transistor 507*b* of the AC photocoupler 507 and the collector and the emitter of the light receiving transistor 517*b* of the AC photocoupler 517 are in a non-conductive state, the capacitor 521 is also charged by the power source Vcc1 via the resistor 522. In this example, a resistance value of the resistor 520 is set smaller than a resistance value of the resistor 522. Thus, when both of the collector and the emitter of the light receiving transistor 507*b* of the AC photocoupler 507 and the collector and the emitter of the light receiving transistor 517*b* of the AC photocoupler 517 are in a conductive state, an electric current of the capacitor 521 has a relationship of (discharge current)>(charge current). A voltage at a node to which the capacitor 521 and the resistor 520 are connected, is input to the inverting input terminal of the comparator 223 to be compared with the reference voltage Vref of the non-inverting input terminal. Subsequent operations are the same as those of the first embodiment, and thus descriptions thereof are omitted.

The above-mentioned state is shown in Table 2.

A first column to a sixth column of Table 2 are the same as the first column to the sixth column of Table 1. The fifth column and the sixth column hold states of the detection circuit 112 and the detection circuit 113, respectively. In Table 2, in State D in which the plurality of triacs 104 and 105 are in a simultaneous conductive state, both of the light emitting portion 507*a* of the detection circuit 112 and the light emitting portion 517*a* of the detection circuit 113 are brought into a light emitting state. Here, State D in which both of the light emitting portion 507*a* of the detection circuit 112 and the light emitting portion 517*a* of the detection circuit 113 are in a light emitting state is different from any other states: States A. B, C, and E. and thus it can be understood that only State D can be accurately detected.

With reference to FIG. 6, a detailed description is given. In FIG. 6, when the triac 104 is brought into a conductive state, the light emitting portion 507*a* of the AC photocoupler 507 of the detection circuit 112 is brought into a light emitting state. Further, when the triac 105 is in a conductive state, the light emitting portion 517*a* of the AC photocoupler 517 of the detection circuit 113 is also brought into a light emitting state. That is, when the triac 104 and the triac 105 are brought into a simultaneous conductive state, both of the light emitting portion 507*a* of the AC photocoupler 507 and the light emitting portion 517*a* of the AC photocoupler 517 are brought into a light emitting state. Meanwhile, when power supply from the AC power source 101 to the fixing apparatus 50 in the second embodiment is stopped (shut-off: OFF), both of the light emitting portion 507*a* of the AC photocoupler 507 and the light emitting portion 517*a* of the AC photocoupler 517 are brought into anon-light emitting state (State E). As described above, both of the light emitting portion 507*a* of the AC photocoupler 507 and the light emitting portion 517*a* of the AC photocoupler 517 are in a light emitting state only when both of the triac 104 and the triac 105 are in a conductive state as shown in Table 2. Thus, the determination portion 114 can distinguish State D and State E from each other, and reliably determine that the triacs 104 and 105 are in a simultaneous conductive state. In Table 1 in the first embodiment, both of the light emitting portion 207*a* of the AC photocoupler 207 and the light emitting portion 217*a* of the AC photocoupler 217 are OFF in both of State D and State E, and thus the determination portion 111 cannot distinguish State D and State E from each other. In this regard, the determination portion 114 in the second embodiment can distinguish State D and State E from each other.

[Operation of Determination Portion]

<Section 1 and Section 2>

With reference to FIG. 7, an operation of the determination portion 114 is described. Part (i) to part (vi) of FIG. 7 are graphs similar to part (i) to part (vi) of FIG. 4. In Section 1 and Section 2, the T1 terminal and the T2 terminal are in a non-conductive state (OFF) in both of the triac 104 and the

TABLE 2

| State | Power supply from AC power source 101 to apparatus | Conductive state between T1 terminal and T2 terminal of triac 104 | Conductive state between T1 terminal and T2 terminal of triac 105 | Light emitting portion 507a of detection circuit 112 | Light emitting portion 517a of detection circuit 113 |
|---|---|---|---|---|---|
| State A | ON | OFF | OFF | Light off | Light off |
| State B | ON | ON | OFF | Light on | Light off |
| State C | ON | OFF | ON | Light off | Light on |
| State D | ON | ON | ON | Light on | Light on |
| State E | OFF | — | — | Light off | Light off |

triac 105. Thus, both of the collector and the emitter of the light receiving transistor 507*b* of the AC photocoupler 507 and the collector and the emitter of the light receiving transistor 517*b* of the AC photocoupler 517 are brought into a non-conductive state (OFF) (State A). As a result, the capacitor 521 of the determination portion 114 is charged by the power source Vcc1 via the resistor 522 so that a voltage of the inverting input terminal of the comparator 223 is increased or fully charged. In Section 1 and Section 2, there is illustrated the capacitor 521 in a fully charged state. In Section 1 and Section 2, the voltage of the inverting input terminal of the comparator 223 is higher than the voltage of the non-inverting input terminal. Thus, an output transistor (not shown) of the comparator 223 is turned ON so that the output of the comparator 223 becomes almost a GND potential. With this, almost all of an electric current supplied from the power source Vcc1 via the resistor 225 is sunk to the output terminal of the comparator 223. Thus, a base current is not supplied to the transistor 227 so that the collector and the emitter of the transistor 227 are brought into a non-conductive state. As a result, in Section 1 and Section 2, the contact of the electromagnetic relay 103 is brought into a conductive state (ON) as instructed by the CPU 219.

<Section 3 and Section 4>

In Section 3 and Section 4, the T1 terminal and the T2 terminal of the triac 104 are in a conductive state (ON), and the T1 terminal and the T2 terminal of the triac 105 are in a non-conductive state (OFF). Under this state, the collector and the emitter of the light receiving transistor 507*b* of the AC photocoupler 507 are brought into a conductive state (ON), and the collector and the emitter of the light receiving transistor 517*b* of the AC photocoupler 517 are brought into a non-conductive state (OFF) (State B). As a result, the capacitor 521 is charged by the power source Vcc1 via the resistor 222 so that the voltage of the inverting input terminal of the comparator 223 is increased or fully charged. In Section 3 and Section 4, the voltage of the inverting input terminal of the comparator 223 is higher than the voltage of the non-inverting input terminal. Thus, the output transistor (not shown) of the comparator 223 is kept ON, and the contact of the electromagnetic relay 103 is maintained in a conductive state (ON).

<Section 5>

In Section 5, the T1 terminal and the T2 terminal are in a conductive state (ON) in both of the triac 104 and the triac 105. This condition means that the apparatus is not normally controlled and is in an abnormal state. Thus, both of the collector and the emitter of the light receiving transistor 507*b* of the AC photocoupler 507 and the collector and the emitter of the light receiving transistor 517*b* of the AC photocoupler 517 are brought into a conductive state (ON) (State D). Under this state, charges of the capacitor 521 are released via the resistor 520, and the voltage of the inverting input terminal of the comparator 223 is reduced. In Section 5, the voltage of the inverting input terminal of the comparator 223 is reduced but does not fall below the reference voltage Vref of the non-inverting input terminal of the comparator 223. Thus, the output transistor (not shown) of the comparator 223 is kept ON, and the contact of the electromagnetic relay 103 is maintained in a conductive state (ON).

<Section 6>

In Section 6, the T1 terminal and the T2 terminal of the triac 104 are in a non-conductive state (OFF), and the T1 terminal and the T2 terminal of the triac 105 are in a conductive state (ON). Under this state, the light receiving transistor 507*b* of the AC photocoupler 507 is brought into a non-conductive state (OFF), and the light receiving transistor 517*b* of the AC photocoupler 517 is brought into a conductive state (ON) (State C). With this, the capacitor 521 is charged by the power source Vcc1 via the resistor 522. In Section 5, the voltage of the inverting input terminal of the comparator 223 is reduced, and thus in Section 6, the voltage of the inverting input terminal of the comparator 223 is increased. The voltage of the inverting input terminal of the comparator 223 is higher than the reference voltage Vref of the non-inverting input terminal of the comparator 223, and thus the output transistor (not shown) of the comparator 223 is kept ON, and the contact of the electromagnetic relay 103 is maintained in a conductive state (ON).

<Section 7 and Section 8>

In Section 7 and Section 8, a period in which the T1 terminal and the T2 terminal are in a conductive state (ON) in both of the triac 104 and the triac 105 (State D) continues for two half wave periods of the AC power source 101. With this, the voltage of the inverting input terminal of the comparator 223 falls below the reference voltage Vref of the non-inverting input terminal of the comparator 223 at a timing "P" in Section 8. Then, the output transistor (not shown) of the comparator 223 is turned OFF so that an output of the comparator 223 is brought into a high impedance (Hiz) state, and a base current is supplied from the power source Vcc1 via the resistor 225 and the resistor 226 to the transistor 227. The collector and the emitter of the transistor 227 supplied with the base current are brought into a conductive state, and an electric current supplied from the CPU 219 to the transistor 229 is sunk by the transistor 227 via the resistor 228. Thus, the collector and the emitter of the transistor 229 are brought into a non-conductive state. Then, the contact of the electromagnetic relay 103 is brought into a non-conductive state (OFF), to thereby shut-off power supply from the AC power source 101 to the heater 251.

The determination portion 114 determines that a simultaneous conductive state of the triac 104 and the triac 105 is confirmed at the timing "0." As a result, the contact of the electromagnetic relay 103 is brought into a non-conductive state, and then maintained in that state by the latch circuit 224 while an electric current of the power source Vcc1 is output. The determination portion in the second embodiment can distinguish the state in which power supply from the AC power source 101 to the apparatus is stopped and the simultaneous conductive state of the plurality of triacs from each other. Thus, unless there are constrains specific to apparatus, it is desirable to adopt the configuration of the second embodiment.

As described above, according to the second embodiment, an accuracy in failure determination of the heating apparatus configured to exclusively supply power to the plurality of heating elements can be improved.

Third Embodiment

Figure 8:
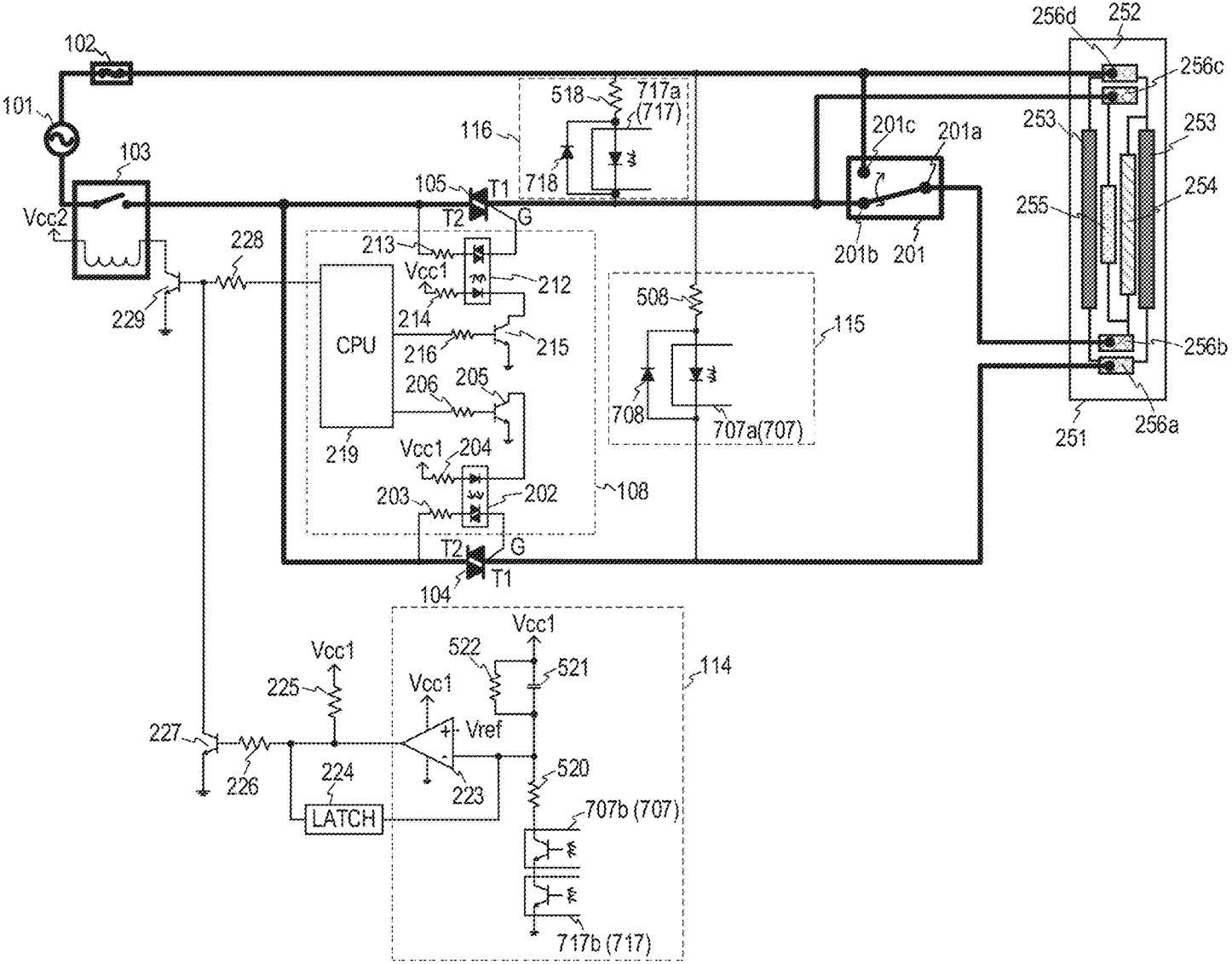
FIG. 8 is a detailed diagram for illustrating a fixing apparatus in the third embodiment.

FIG. 8 is a detailed circuit diagram of the fixing apparatus 50 described in a third embodiment. The circuit block diagram is the same as that in the second embodiment, specifically, the diagram of FIG. 5. The same components as the above-mentioned components are denoted by identical reference symbols, and descriptions thereof are omitted. The circuit block diagram and circuit connection of the third embodiment are the same as those of the second embodiment, but elements used in a detection circuit 115 and a detection circuit 116 are different from those of the second embodiment. In the second embodiment, the AC photocoupler 507 and the AC photocoupler 517 are used in the detection circuit 112 and the detection circuit 113, respectively. Meanwhile, in the third embodiment, a photocoupler adapted to direct current (hereinafter referred to as "DC photocoupler") 707 and a DC photocoupler 717 are used in the detection circuit 115 and the detection circuit 116, respectively. The DC photocoupler 707 and the DC photocoupler 717 are configured to detect a simultaneous conductive state of the triac 104 and the triac 105 with one polarity of the AC power source 101 (hereinafter referred to as "single polarity") (in the third embodiment, in a section of positive half wave, for example). The DC photocoupler is generally low-cost and easily available compared with the AC photocoupler. The DC photocoupler is applicable to any apparatus that is free from a problem of excessive temperature rise of the heater 251 caused by the plurality of heating elements generating heat at the same time even though a simultaneous conductive state of the triac 104 and the triac 105 is detected with only one polarity of the AC power source 101. A diode 708 is a protective diode of a light emitting portion 707*a* of the DC photocoupler 707, and a diode 718 is a protective diode of a light emitting portion 717*a* of the DC photocoupler 717. A resistor 508 is a current limiting resistor for the light emitting portion 707*a* of the DC photocoupler 707, and a resistor 518 is a current limiting resistor for the light emitting portion 717*a* of the DC photocoupler 717.

[Detection Circuit]

Description is given of the detection circuit 115 and the detection circuit 116 configured to detect conductive states of the triacs 104 and 105, respectively. In the following description, it is assumed that a section of positive half wave of the AC power source 101 is adopted. The detection circuit 115 is connected in series to between the T1 terminal and the T2 terminal of the triac 104. In a case of the T1 terminal and the T2 terminal of the triac 104 being in a non-conductive state, the light emitting portion 707*a* of the DC photocoupler 707 does not emit light, and a collector and an emitter of a light receiving transistor 707*b* of the DC photocoupler 707 are brought into a non-conductive state. Meanwhile, when the T1 terminal and the T2 terminal of the triac 104 are in a conductive state, an electric current flows from the AC power source 101 via a current limiting resistor 508 so that the light emitting portion 707*a* of the DC photocoupler 707 emits light. As a result, the collector and the emitter of the light receiving transistor 707*b* of the DC photocoupler 707 are brought into a conductive state.

The detection circuit 116 is connected in series to between the T1 terminal and the T2 terminal of the triac 105. In a case of the T1 terminal and the T2 terminal of the triac 105 being in a non-conductive state, a light emitting portion 717*a* of a DC photocoupler 717 does not emit light, and a collector and an emitter of a light receiving transistor 717*b* of the DC photocoupler 717 are brought into a non-conductive state. Meanwhile, when the T1 terminal and the T2 terminal of the triac 105 are in a conductive state, an electric current flows from the AC power source 101 via a current limiting resistor 518 so that the light emitting portion 717*a* of the DC photocoupler 717 emits light. As a result, the collector and the emitter of the light receiving transistor 717*b* of the DC photocoupler 717 are brought into a conductive state.

The above-mentioned state is shown in Table 3.

TABLE 3

| State | Power supply from AC power source 101 to apparatus | Conductive state between T1 terminal and T2 terminal of triac 104 | Conductive state between T1 terminal and T2 terminal of triac 105 | Light emitting portion 707a of detection circuit 115 | Light emitting portion 717a of detection circuit 116 |
|---|---|---|---|---|---|
| State A | ON | OFF | OFF | Light off | Light off |
| State B | ON | ON | OFF | Light on (only in positive half wave period of AC power source 101) | Light off |
| State C | ON | OFF | ON | Light off | Light on (only in positive half wave period of AC power source 101) |
| State D | ON | ON | ON | Light on (only in positive half wave period of AC power source 101) | Light on (only in positive half wave period of AC power source 101) |
| State E | OFF | — | — | Light off | Light off |

A first column to a sixth column of Table 3 are the same as the first column to the sixth column of Table 2. The fifth column and the sixth column hold states of the detection circuit 115 and the detection circuit 116, respectively. In the third embodiment, the light emitting portion 707*a* of the detection circuit 115 and the light emitting portion 717*a* of the detection circuit 116 emit light only in a positive half wave period of the AC power source 101.

[Operation of Determination Portion]

<Section 4>

Figure 9:
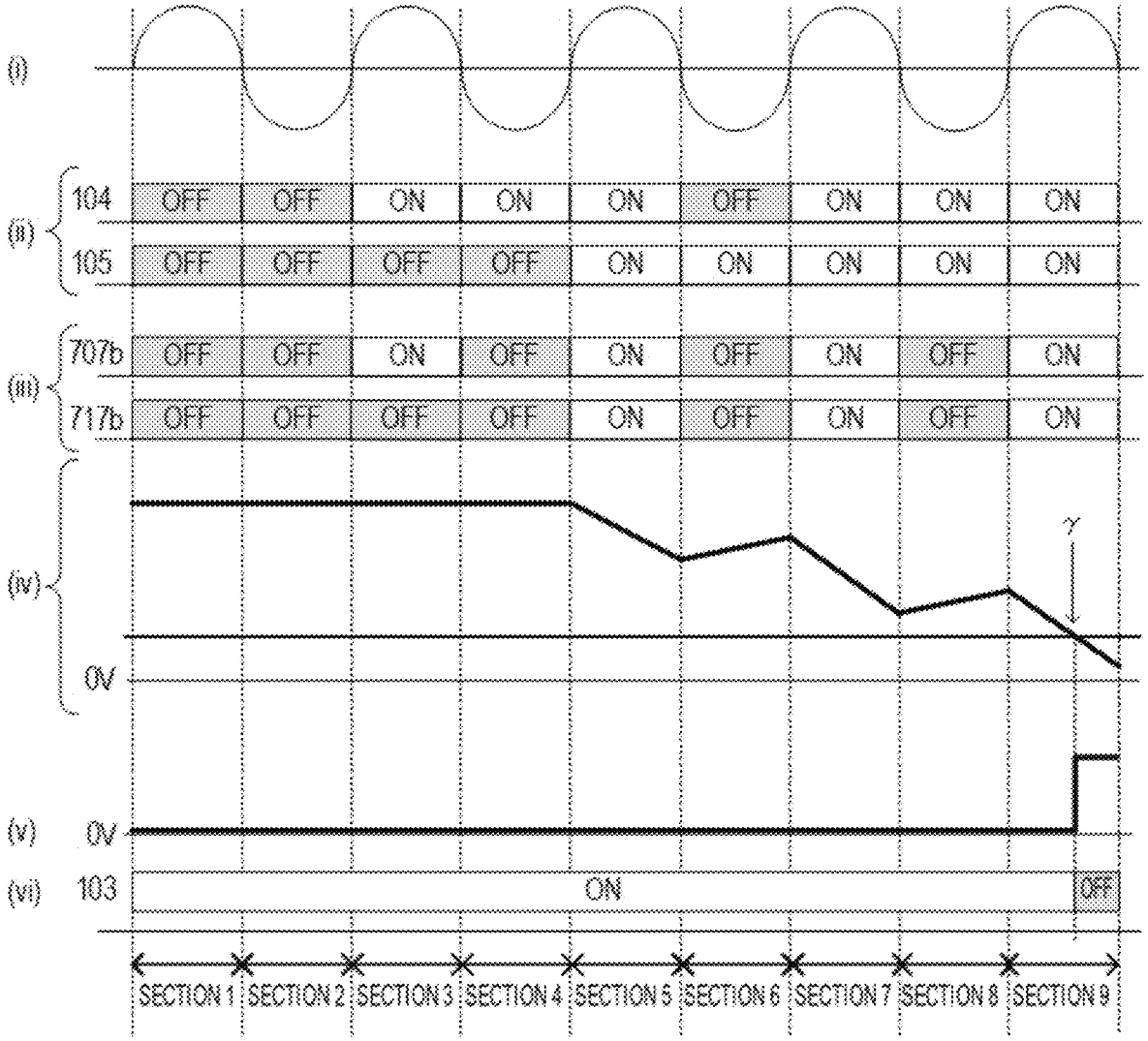
FIG. 9 is a sequence chart for showing an operation of a determination portion in the third embodiment.

With reference to FIG. 9, description is given of an abnormality determination operation of the determination portion 114 in the third embodiment. Part (i) to part (vi) of FIG. 9 are similar graphs to the graphs of part (i) to part (vi) of FIG. 7, and thus only sections different between FIG. 9 and FIG. 7 are described. In Section 4 of FIG. 9, the T1 terminal and the T2 terminal of the triac 104 are in a conductive state (ON). However, in Section 4 (in a negative half wave period of the AC power source 101), the light emitting portion 707*a* of the DC photocoupler 707 does not emit light, and the detection circuit 115 cannot detect that the T1 terminal and the T2 terminal of the triac 104 are in a conductive state (ON). Thus, the collector and the emitter of the light receiving transistor 707*b* of the DC photocoupler 707 of the detection circuit 115 are brought into a non-conductive state (OFF).

<Section 6>

In Section 6, as in Section 4, the detection circuit 116 cannot detect that the T1 terminal and the T2 terminal of the triac 105 are in a conductive state (ON). Hence, the collector and the emitter of the light receiving transistor 717*b* of the DC photocoupler 717 of the detection circuit 116 are brought into a non-conductive state (OFF).

<Section 7 to Section 9>

In Section 7 to Section 9, both of the T1 terminal and the T2 terminal of the triac 104 and the T1 terminal and the T2 terminal of the triac 105 are in a conductive state (ON). Section 7 and Section 9 correspond to a positive half wave period of the AC power source 101, and thus the detection circuit 115 and the detection circuit 116 detect that both of the T1 terminal and the T2 terminal of the triac 104 and the T1 terminal and the T2 terminal of the triac 105 are in a conductive state (ON) (State D). As a result, the voltage of the non-inverting input terminal of the comparator 223 is reduced.

Meanwhile, Section 8 corresponds to a negative half wave period of the AC power source 101, and the detection circuit 115 and the detection circuit 116 cannot detect that both of the T1 terminal and the T2 terminal of the triac 104 and the T1 terminal and the T2 terminal of the triac 105 are in a conductive state (ON). As a result, the voltage of the non-inverting input terminal of the comparator 223 is increased. Thus, in Section 7 to Section 9, as illustrated in FIG. 9, the voltage of the non-inverting input terminal of the comparator 223 falls below the reference voltage Vref of the inverting input terminal at a timing "y" in Section 9 after being reduced and increased. As a result, the contact of the electromagnetic relay 103 is brought into a non-conductive state (OFF), and power supply from the AC power source 101 to the heater 251 is shut-off. This state is maintained by the latch circuit 224 while an electric current of the power source Vcc1 is output.

As described above, with the configuration of the third embodiment, the DC photocouplers 707 and 717 are used to detect the simultaneous conductive state of the triacs 104 and 105 depending on the polarity of the AC power source 101. Thus, as compared with a case of using the AC photocoupler, it takes longer time for the determination portion 114 to confirm the simultaneous conductive state of the plurality of triacs 104 and 105. Specifically, in the second embodiment, the determination portion 114 confirms the simultaneous conductive state of the plurality of triacs 104 and 105 with two half wave periods of the AC power source 101 (at the timing "0" in Section 8). In contrast, in the third embodiment that adopts the DC photocouplers, the determination portion 114 requires at least three half wave periods (at the timing "y" in Section 9) to confirm the simultaneous conductive state of the plurality of triacs 104 and 105. Despite the above, the DC photocoupler is generally available at lower cost than that of the AC photocoupler, and thus the apparatus can be provided at low cost.

In the third embodiment, the DC photocouplers are connected so that the simultaneous conductive state of the triacs can be detected in a positive half wave period of the AC power source 101. However, the following configuration may be adopted, the DC photocouplers are connected with their light emitting portions having an opposite polarity so that the simultaneous conductive state of the triacs 104 and 105 can be detected in a negative half wave period of the AC power source 101. Further, the DC photocoupler may be applied to the detection circuits 109 and 110 of the first embodiment.

As described above, according to the third embodiment, an accuracy in failure determination of the heating apparatus configured to exclusively supply power to the plurality of heating elements can be improved.

According to the embodiments, an accuracy in failure determination of the heating apparatus configured to exclusively supply power to the plurality of heating elements can be improved.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-038910, filed Mar. 6, 2020, which is hereby incorporated by reference herein in its entirety.

What is claimed is:

1. A heating apparatus comprising:

a first heating element;

a first switch element configured to switch between power supply from an AC power source to the first heating element and shut-off of power;

a second heating element;

a second switch element configured to switch between power supply from the AC power source to the second heating element and shut-off of power;

a control unit configured to control the first switch element and the second switch element to supply power to either the first heating element or the second heating element;

a first detection unit configured to detect that the first switch element is in a conductive state or a non-conductive state;

a second detection unit configured to detect that the second switch element is in a conductive state or a non-conductive state;

a determination unit configured to determine whether both of the first heating element and the second heating element are in a state of being supplied with power, based on a result of detection by the first detection unit and a result of detection by the second detection unit; and a connection unit connected to a power supply path electrically connecting between the AC power source and each of the first switch element and the second switch element, the connection unit being brought into a connected state in which power is supplied from the AC power source to the first switch element and the second switch element or a non-connected state in which power supply is shut-off, wherein in a case in which the determination unit determines that both of the first heating element and the second heating element are in the state of being supplied with power, the determination unit switches the connection unit from the connected state to the non-connected state.

2. The heating apparatus according to claim 1, wherein the first detection unit is connected in parallel to the first switch element, and wherein the second detection unit is connected in parallel to the second switch element.

3. The heating apparatus according to claim 2, wherein the first detection unit includes an AC photocoupler, and the second detection unit includes an AC photocoupler, and wherein the determination unit determines that both of the first heating element and the second heating element are in the state of being supplied with power in a case in which a light emitting portion of the AC photocoupler of the first detection unit is lighting off and a light emitting portion of the AC photocoupler of the second detection unit is lighting off.

4. The heating apparatus according to claim 1, wherein the first detection unit is connected in series to the first switch element, and wherein the second detection unit is connected in series to the second switch element.

5. The heating apparatus according to claim 4, wherein the first detection unit includes an AC photocoupler, and the second detection unit includes an AC photocoupler, and wherein the determination unit determines that both of the first heating element and the second heating element are in the state of being supplied with power in a case in which a light emitting portion of the AC photocoupler of the first detection unit is lighting on and a light emitting portion of the AC photocoupler of the second detection unit is lighting on.

6. The heating apparatus according to claim 5, wherein the determination unit determines that power supply from the AC power source is shut-off in a case in which the light emitting portion of the AC photocoupler of the first detection unit is lighting off and the light emitting portion of the AC photocoupler of the second detection unit is lighting off.

7. The heating apparatus according to claim 2, wherein the determination unit is configured to determine whether both of the first heating element and the second heating element are in the state of being supplied with power in both a positive half wave period and a negative half wave period of the AC power source.

8. The heating apparatus according to claim 4, wherein the first detection unit includes a DC photocoupler, and the second detection unit includes a DC photocoupler, and wherein the determination unit determines that both of the first heating element and the second heating element are in the state of being supplied with power in a case in which a light emitting portion of the DC photocoupler of the first detection unit is lighting on and a light emitting portion of the DC photocoupler of the second detection unit is lighting on.

9. The heating apparatus according to claim 8, wherein the determination unit determines that power supply from the AC power source is shut-off in a case in which the light emitting portion of the DC photocoupler of the first detection unit is lighting off and the light emitting portion of the DC photocoupler of the second detection unit is lighting off.

10. The heating apparatus according to claim 8, wherein the determination unit determines whether both of the first heating element and the second element are in the state of being supplied with power in either a positive half wave period or a negative half wave period of an AC voltage of the AC power source.

11. The heating apparatus according to claim 1, further comprising:

a first rotary member to be heated by the first heating element serving or the second heating element;

a heater arranged in an internal space of the first rotary member and including a circuit board on which the first heating element and the second heating element are arranged; and a second rotary member configured to form a nip portion together with the first rotary member, wherein the first heating element and the second heating element are different in heat distribution in a longitudinal direction of the circuit.

12. The heating apparatus according to claim 11, wherein the first rotary member is a film.

13. The heating apparatus according to claim 12, wherein the nip portion is formed by the heater and the second rotary member via the film.

14. The heating apparatus according to claim 1, further comprising:

a third heating element; and a heater including a circuit board on which the first heating element, the second heating element, and the third heating element are arranged, wherein the second heating element has a length in a longitudinal direction of the circuit board that is shorter than a length of the first heating element, wherein the third heating element has a length in the longitudinal direction that is shorter than the length of the second heating element, wherein another first heating element is arranged on the circuit board, wherein the first heating element is provided at one end portion in a short direction of the circuit board, and the another first heating element is provided at another end portion in the short direction, and wherein in the short direction, the first heating element, the second heating element, the third heating element, and the another first heating element are arranged in order of mention.

15. The heating apparatus according to claim 14, further comprising:

a first contact to which one end portion of the two first heating element and one end portion of the another first heating portion are electrically connected;

a second contact to which another end portion of the first heating element, another end portion of the another first heating element, and an end portion of the second heating element are electrically connected;

a third contact to which another end portion of the second heating element and an end portion of the third heating element are electrically connected; and a fourth contact to which another end portion of the third heating element is electrically connected.

16. An image forming apparatus comprising:

an image bearing member on which an electrostatic latent image is to be formed;

a developing unit configured to apply toner to the electrostatic latent image formed on the image bearing member to form a toner image;

a transfer unit configured to transfer the toner image to a recording material; and a heating apparatus, comprising:

a first heating element;

a first switch element configured to switch between power supply from an AC power source to the first heating element and shut-off of power;

a second heating element;

a second switch element configured to switch between power supply from the AC power source to the second heating element and shut-off of power;

a control unit configured to control the first switch element and the second switch element to supply power to one of the first heating element and the second heating element;

a first detection unit configured to detect that the first switch element is in a conductive state or a non-conductive state;

a second detection unit configured to detect that the second switch element is in a conductive state or a non-conductive state;

a determination unit configured to determine whether both of the first heating element and the second heating element are in a state of being supplied with power, based on a result of detection by the first detection unit and a result of detection by the second detection unit; and a connection unit connected to a power supply path electrically connecting between the AC power source and each of the first switch element and the second switch element, the connection unit being brought into a connected state in which power is supplied from the AC power source to the first switch element and the second switch element or a non-connected state in which power supply is shut-off, wherein in a case in which the determination unit determines that both of the first heating element and the second heating element are in the state of being supplied with power, the determination unit switches the connection unit from the connected state to the non-connected state, and wherein the toner image transferred and unfixed to the recording material is heated by the first heating element or the second heating element to fix the toner image to the recording material.

17. An image forming apparatus comprising:

an image bearing member on which an electrostatic latent image is to be formed;

a developing unit configured to apply toner to the electrostatic latent image formed on the image bearing member to form a toner image;

a transfer unit configured to transfer the toner image to a recording material; and a heating apparatus, comprising:

a first heating element;

a first switch element configured to switch between power supply from an AC power source to the first heating element and shut-off of power;

a second heating element;

a second switch element configured to switch between power supply from the AC power source to the second heating element and shut-off of power;

a control unit configured to control the first switch element and the second switch element to supply power to one of the first heating element and the second heating element;

a first detection unit configured to detect that the first switch element is in a conductive state or a non-conductive state;

a second detection unit configured to detect that the second switch element is in a conductive state or a non-conductive state;

a determination unit configured to determine whether both of the first heating element and the second heating element are in a state of being supplied with power, based on a result of detection by the first detection unit and a result of detection by the second detection unit;

a third heating element;

a heater including a circuit board on which the first heating element, the second heating element, and the third heating element are arranged, wherein the second heating element has a length in a longitudinal direction of the circuit board that is shorter than a length of the first heating element;

wherein the third heating element has a length in the longitudinal direction that is shorter than the length of the second heating element, wherein another first heating element is arranged on the circuit board, wherein the first heating element is provided at one end portion in a short direction of the circuit board, and the another first heating element is provided at another end portion in the short direction, wherein in the short direction, the first heating element, the second heating element, the third heating element, and the another first heating element are arranged in order of mention, and wherein the toner image transferred and unfixed to the recording material is heated by the first heating element, the another first heating element, the second heating element, or the third heating element to fix the toner image to the recording material; and a switching unit configured to switch between a power supply path from the AC power source to the second heating element and a power supply path from the AC power source to the third heating element, wherein the control unit controls the first switch element and the second switch element in accordance with a length of the recording material in a direction orthogonal to a conveyance direction of the recording material, and also control the switching unit.

18. A heating apparatus comprising:

a first heating element;

a first switch element configured to switch between power supply from an AC power source to the first heating element and shut-off of power;

a second heating element;

a second switch element configured to switch between power supply from the AC power source to the second heating element and shut-off of power;

a control unit configured to control the first switch element and the second switch element to supply power to either the first heating element or the second heating element;

a first detection unit configured to detect that the first switch element is in a conductive state or a non-conductive state;

a second detection unit configured to detect that the second switch element is in a conductive state or a non-conductive state;

a determination unit configured to determine whether both of the first heating element and the second heating element are in a state of being supplied with power, based on a result of detection by the first detection unit and a result of detection by the second detection unit;

a third heating element; and a heater including a circuit board on which the first heating element, the second heating element, and the third heating element are arranged, wherein the second heating element has a length in a longitudinal direction of the circuit board that is shorter than a length of the first heating element, wherein the third heating element has a length in the longitudinal direction that is shorter than the length of the second heating element, wherein another first heating element is arranged on the circuit board, wherein the first heating element is provided at one end portion in a short direction of the circuit board, and the another first heating element is provided at another end portion in the short direction, and wherein in the short direction, the first heating element, the second heating element, the third heating element, and the another first heating element are arranged in order of mention.

19. The heating apparatus according to claim 1, wherein each of the first switch element and the second switch element is a triac.

* * * * *